US010807391B2

(12) United States Patent
Hutnak et al.

(10) Patent No.: US 10,807,391 B2
(45) Date of Patent: Oct. 20, 2020

(54) DURABLE MOBILE PRINTER

(71) Applicant: Zebra Technologies Corporation, Lincolnshire, IL (US)

(72) Inventors: Robert A. Hutnak, Douglas, MA (US); James A. Lucas, Coventry, RI (US); Anthony R. Helberg, Attleboro, MA (US); Matthew D. Corvese, Warwick, RI (US); Roy P. Lyman, Coventry, RI (US)

(73) Assignee: Zebra Technologies Corporation, Lincolnshire, IL (US)

( * ) Notice: Subject to any disclaimer, the term of this patent is extended or adjusted under 35 U.S.C. 154(b) by 0 days.

(21) Appl. No.: 15/281,570

(22) Filed: Sep. 30, 2016

(65) Prior Publication Data

US 2017/0015117 A1 Jan. 19, 2017

Related U.S. Application Data

(63) Continuation of application No. 14/623,377, filed on Feb. 16, 2015, now Pat. No. 9,487,022.

(51) Int. Cl.
*B41J 15/04* (2006.01)
*B41J 11/04* (2006.01)
(Continued)

(52) U.S. Cl.
CPC ..... *B41J 15/042* (2013.01); *B41J 3/36* (2013.01); *B41J 11/0045* (2013.01); *B41J 11/04* (2013.01); *B41J 15/046* (2013.01); *B41J 29/02* (2013.01); *B41J 29/023* (2013.01); *B41J 29/13* (2013.01); *B41J 29/54* (2013.01); *B41J 29/56* (2013.01); *E05D 5/14* (2013.01); *E05D 7/009* (2013.01);
(Continued)

(58) Field of Classification Search
CPC ..... B41J 3/36; B41J 29/023
See application file for complete search history.

(56) References Cited

U.S. PATENT DOCUMENTS 9,487,022 B2 * 11/2016 Hutnak ..... B41J 3/36
2003/0103793 A1 6/2003 Murakoshi et al.
(Continued)

OTHER PUBLICATIONS

International Electrotechnical Standard Commission Standard IEC 60068-2-32 Ed. 2.0 (incorporated in IEC 60062-2-31 Ed. 2.0 (May 2008); 16 pages; Available in U.S. Appl. No. 14/623,377 to which priority is claimed.

(Continued)

*Primary Examiner* — Matthew Luu
*Assistant Examiner* — Kendrick X Liu

(57) ABSTRACT

Embodiments of the present invention provide improvements to printers including the use of engineered structures to limit bending, flexing, and/or twisting during impacts and the use of impact absorbing materials to prevent cracks and breaks. Design features and materials add to the rigidity of the printer design to prevent twisting and flexing during impacts and add to the strength of the printer design in typical breakage areas. For example, embodiments provide improvements that strengthen traditional break areas by the use of improved materials and design optimization to distribute impact forces. Embodiments allow the printer to maintain an operational status following a drop test and/or a tumble test.

20 Claims, 32 Drawing Sheets

(51) Int. Cl.

| | |
|---|---|
| ***B41J 3/36*** | (2006.01) |
| ***B41J 29/02*** | (2006.01) |
| ***B41J 29/13*** | (2006.01) |
| ***B41J 29/56*** | (2006.01) |
| ***E05D 13/00*** | (2006.01) |
| ***E05D 15/08*** | (2006.01) |
| ***E05D 15/28*** | (2006.01) |
| ***E05D 7/00*** | (2006.01) |
| ***E05D 5/14*** | (2006.01) |
| ***B41J 29/54*** | (2006.01) |
| ***B41J 11/00*** | (2006.01) |

(52) U.S. Cl.
CPC ..... *E05D 13/1207* (2013.01); *E05D 15/08* (2013.01); *E05D 15/28* (2013.01)

(56) References Cited

U.S. PATENT DOCUMENTS

| | | | | |
|---|---|---|---|---|
| 2005/0162497 | A1 | 7/2005 | Matsui et al. | |
| 2006/0216098 | A1* | 9/2006 | Lyman | B41J 3/4075 400/613 |
| 2011/0200375 | A1* | 8/2011 | Kokawa | B41J 3/4075 400/578 |

OTHER PUBLICATIONS

Department of Defense Test Method Standard MIL-STD-810G Method 516.6, Procedure IV; dated Oct. 31, 2008; 48 pages; Available in U.S. Appl. No. 14/623,377 to which priority is claimed.

* cited by examiner

Rib structure in upper housing behind spring bar reduces flex between back side and front side

DURABLE MOBILE PRINTER

RELATED APPLICATION

This patent arises from a continuation of U.S. patent application Ser. No. 14/623,377, filed Feb. 16, 2015, which is hereby incorporated herein by reference in its entirety.

TECHNOLOGICAL FIELD

An example embodiment of the present invention relates generally to mobile printers, and more specifically to durable mobile printers structured to maintain an operational status after impacts.

BACKGROUND

Mobile printers are used in a variety of applications and environments. In some cases, mobile printers may be subjected to unexpected impacts and drops while in operation or transit which may result in excessive movement of printer components and result in components disassembling, misaligning, or breaking. Such excessive movements may cause damage to components resulting in printer failure and necessitating replacement of the components, possibly at considerable expense and significant downtime for the printer.

A number of deficiencies and problems associated with mobile printers are identified herein. Through applied effort, ingenuity, and innovation, exemplary solutions to many of these identified problems are embodied by the present invention, which is described in detail below.

BRIEF SUMMARY

Systems and apparatuses are therefore provided according to example embodiments of the present invention to provide improvements to mobile printer durability and to maintain a printer operational status after an impact.

In one embodiment, a printer is provided comprising a hinge pin defining a hinge pin length; an inner cover frame defining two or more first barrel hinge members, the two or more first barrel hinge members defining an outer hinge width; an outer cover defining two or more second barrel hinge members; and a media receiving housing defining two or more third barrel hinge members; the first barrel hinge members, the second barrel hinge members, and the third barrel hinge members are respectively structured for positioning in a coaxial arrangement for receiving the hinge pin, the hinge pin length being substantially equal to the outer hinge width, and the outer cover is pivotable relative to the media receiving housing from a closed position to a media access position when the first barrel hinge members, the second barrel hinge members, and the third barrel hinge members have received the hinge pin.

In some embodiments, the printer may further comprise the inner cover frame defining a first plurality of fastener receivers and the outer cover defining a second plurality of fastener receivers, the first plurality of fastener receivers and the second plurality of fastener receivers structured to affix the inner cover frame to the outer cover such that the inner cover frame and the outer cover are jointly pivotable from the closed position to the media access position.

In some embodiments, the printer may further comprise an outer housing; the outer housing defining one or more tongue structures proximate a media lock edge; the media receiving housing defining one or more groove structures proximate a housing lock edge; the one or more groove structures of the media receiving housing are structured to securely receive the one or more tongue structures of the outer housing as the housing lock edge of the media receiving housing seats into the media lock edge of the outer housing.

In some embodiments, the printer may further comprise a third plurality of fastener receivers at the outer extremes of the media receiving housing proximate the housing lock edge of the media receiving housing and proximate the media exit edge of the media receiving housing, the third plurality of fastener receivers structured to securely affix the media receiving housing with the outer housing.

In some embodiments, the printer may further comprise the outer cover defining one or more cover interlock elements, the cover interlock elements defining one or more recess surfaces; and the outer housing defining one or more housing interlock elements, the housing interlock elements defining one or more rib surfaces; the cover interlock element recess surfaces and the housing interlock element rib surfaces structured such that they proximately align when the outer cover is rotated from the media access position to the closed position; the cover interlock elements and the housing interlock elements structured to prevent the misaligning of the outer cover and the outer housing during an impact.

In some embodiments, the printer may further comprise wherein the outer housing further defines a rib structure extending proximate a spring bar, the rib structure structured to reduce flexing between a first portion of the outer housing and a second portion of the outer housing and to disburse forces received by the outer housing through the spring bar.

In some embodiments, the printer may further comprise a lower housing defining a battery pack box and first and second sidewalls, the lower housing further defining a plurality of ribs extending generally between the battery pack box and each of the first and second sidewalls, the plurality of ribs configured to provide added rigidity to the lower housing.

In some embodiments, the printer may further comprise the lower housing defining one or more lower housing tongue and groove structures, the lower housing tongue and groove structures running along an outer housing join edge of each of a display side, a first sidewall, and a second sidewall of the lower housing; and the outer housing defining one or more outer housing tongue and groove structures, the outer housing tongue and groove structures running along a lower housing join edge of each of a display side, a second side, and a third side of the outer housing; the lower housing tongue and groove structures of the lower housing structured to align with the outer housing tongue and groove structures of the outer housing, and the lower housing tongue and groove structures and the outer housing tongue and groove structures structured as secure join points between the lower housing and the outer housing.

In some embodiments, the printer may further comprise the lower housing further defining two or more finger joints proximate an outer housing interface edge of the lower housing; and the outer housing further defining two or more reciprocal finger joints proximate a lower housing interface edge of the outer housing; the two or more reciprocal finger joints of the outer housing structured to securely receive the two or more finger joints of the lower housing.

In some embodiments, the printer may further comprise wherein the lower housing further defines a fourth plurality of fastener receivers proximate the outer housing interface edge of the lower housing, the fourth plurality of fastener receivers structured to securely join at least the lower housing, the outer housing, and the media receiving housing.

In some embodiments, the printer may further comprise the lower housing defining a step feature proximate a display edge of the lower housing, the step feature structured to receive a bumper component; and the step feature and the bumper component structured to transmit impact loads and stresses away from a display side of the printer.

In some embodiments, the printer may further comprise a display module coupled to the outer housing, the display module being proximate the step feature of the lower housing and above the bumper component; the bumper component structured to extend outwardly beyond a forward edge of the display module to reduce impact stress to display module components from front impacts proximate the display module.

In some embodiments, the printer may further comprise the media receiving housing defining a media guide assembly proximate a media exit side of the media receiving housing, the media guide assembly defining a media guide belt assembly; and a print frame defining an attachment surface with a fifth plurality of fastener receivers, the print frame attachment surface structured to securely attach proximate an external surface of the media exit side of the media receiving housing and over the media guide belt assembly via the fifth plurality of fastening receivers; the print frame attachment surface and the external surface of the media exit side of the media receiving housing structured to act as a complete boxed assembly for the media guide belt assembly, the complete boxed assembly structured to prevent separation of components of the media guide belt assembly.

In some embodiments, the printer may further comprise the media guide assembly defining a media guide belt structured to encourage synchronous movement of a first media guide and a second media guide of a media centering mechanism, the first media guide and the second media guide defining a first plurality of lugs and the media guide belt defining a second plurality of lugs structured to securely attach the media guide belt to the media guide assembly where the first plurality of lugs is of equivalent number to the second plurality of lugs and, the first and second pluralities of lugs structured to prevent slipping or cutting of the media guide belt under side impact stresses.

In some embodiments, the printer may further comprise a platen holder affixed proximate a platen edge of the inner cover frame, the platen holder structured to securely retain a platen; the platen holder defining a first hole through a first solid endpiece of the platen holder and a second hole through a second solid endpiece of the platen holder; the first hole structured to completely encircle a first end of the platen and the second hole structured to completely encircle a second end of the platen; the platen holder structured to prevent the platen from breaking free from the inner cover frame under impact stresses.

In some embodiments, the printer may further comprise a cover stop defining a cover stop length and proximate a hinge edge of the outer cover, the hinge edge of the outer cover defining a cover width; the cover stop length being substantially equal to the outer cover width; and the cover stop structured to disperse forces across an entire printer width when the outer cover is in the media access position.

In some embodiments, the printer may further comprise the first barrel hinge members, the second barrel hinge members, and the third barrel hinge members having received the hinge pin, structured to be in a recessed position within a hinge edge of the outer housing and a hinge edge of the outer cover when the outer cover is in the closed position; the recessed position structured to provide protection during drop impacts.

In some embodiments, the printer may further comprise wherein the printer is structured to maintain an operational status following a drop test based on the Department of Defense Test Method Standard MIL-STD-810G Method 516.6, procedure IV.

In some embodiments, the drop test comprises a plurality of two meter drops initiated from different printer drop orientations. In some embodiments, the drop test comprises twenty six drops, each drop initiated from different printer drop orientations of the printer. In some embodiments, the drop test is repeated for a plurality of different temperatures. In some embodiments, the printer is structured to reduce hard failures when subjected to a drop test based on a MIL-STD-810G Method 516.6, procedure IV specifications. In some embodiments, it is acceptable for the printer to suffer a limited number of soft failures. In some embodiments, the printer may further comprise wherein the printer is structured to maintain an operational status following a tumble test based on the International Electrotechnical Commission standard IEC 60068-2-32 Ed. 2.0 (incorporated in IEC 60068-2-31 Ed 2.0 (2008-05)).

In some embodiments, the tumble test comprises a plurality of one meter tumbles. In some embodiments, the printer is structured to maintain an operational status following 750 tumbles. In some embodiments, the printer is structured to maintain an operational status following 1000 tumbles. In some embodiments, the printer is structured to maintain an operational status following 1500 tumbles. In some embodiments, the printer is structured to maintain an operational status following 2000 tumbles. In some embodiments, the printer is structured to reduce hard failures when subjected to a tumble test based on an IEC 60068-2-32 specification. In some embodiments, it is acceptable for the printer to suffer a limited number of soft failures.

In another embodiment, a printer is provided comprising a media receiving housing defining a media guide assembly structured to provide a media centering mechanism within the media receiving housing; the media guide assembly defining a media guide belt structured to aid joint movement of a first media guide and a second media guide of the media centering mechanism; and the media guide belt defining a plurality of lugs structured to securely attach the media guide belt to the media guide assembly.

In another embodiment, a printer is provided comprising a platen holder affixed proximate a platen edge of an inner cover frame, the platen holder structured to securely retain a platen; the platen holder defining a first hole through a first solid endpiece of the platen holder and a second hole through a second solid endpiece of the platen holder; the first hole structured to completely encircle a first end of the platen and the second hole structured to completely encircle a second end of the platen; the platen holder structured to prevent the platen from breaking free from the inner cover frame under impact stresses.

BRIEF DESCRIPTION OF THE DRAWINGS

Figure 1A:
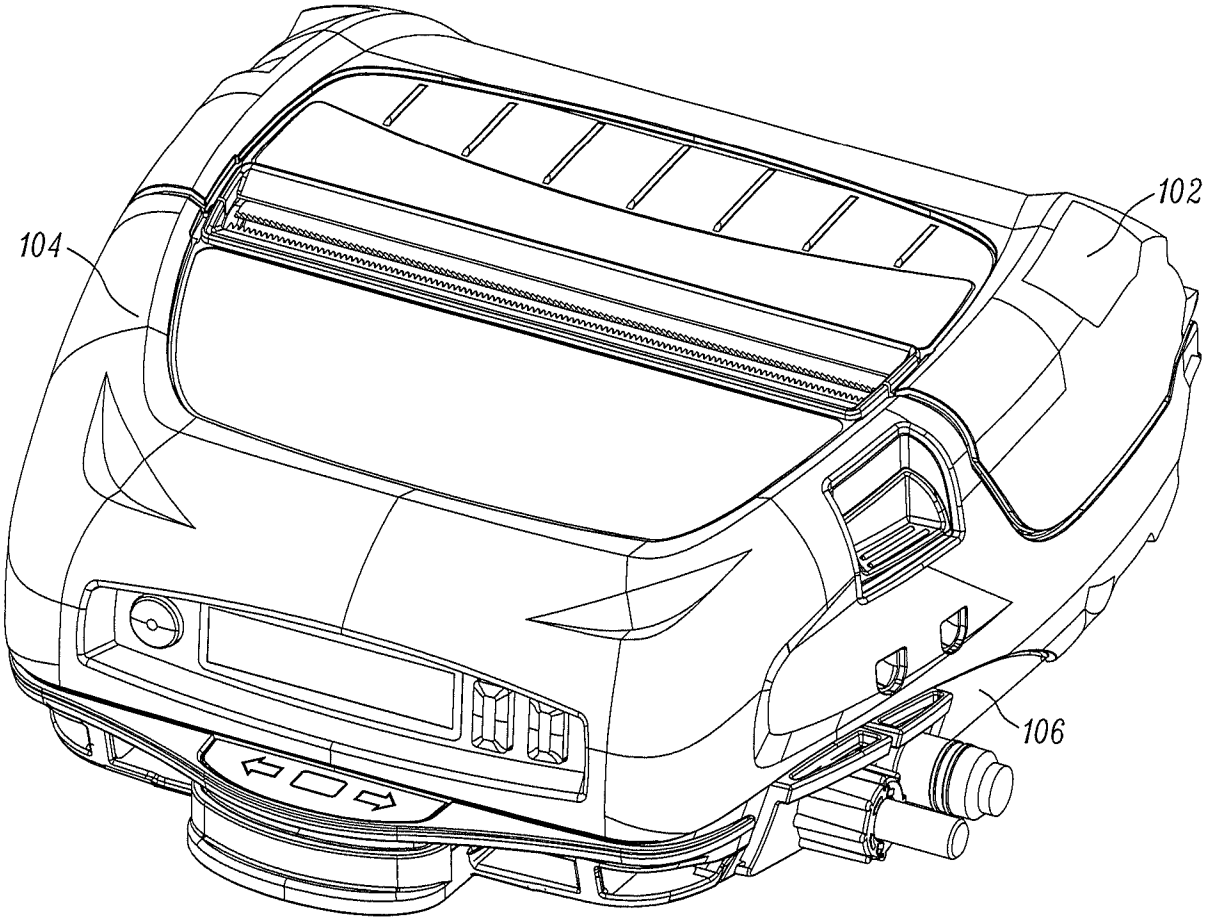
Figure 1B:
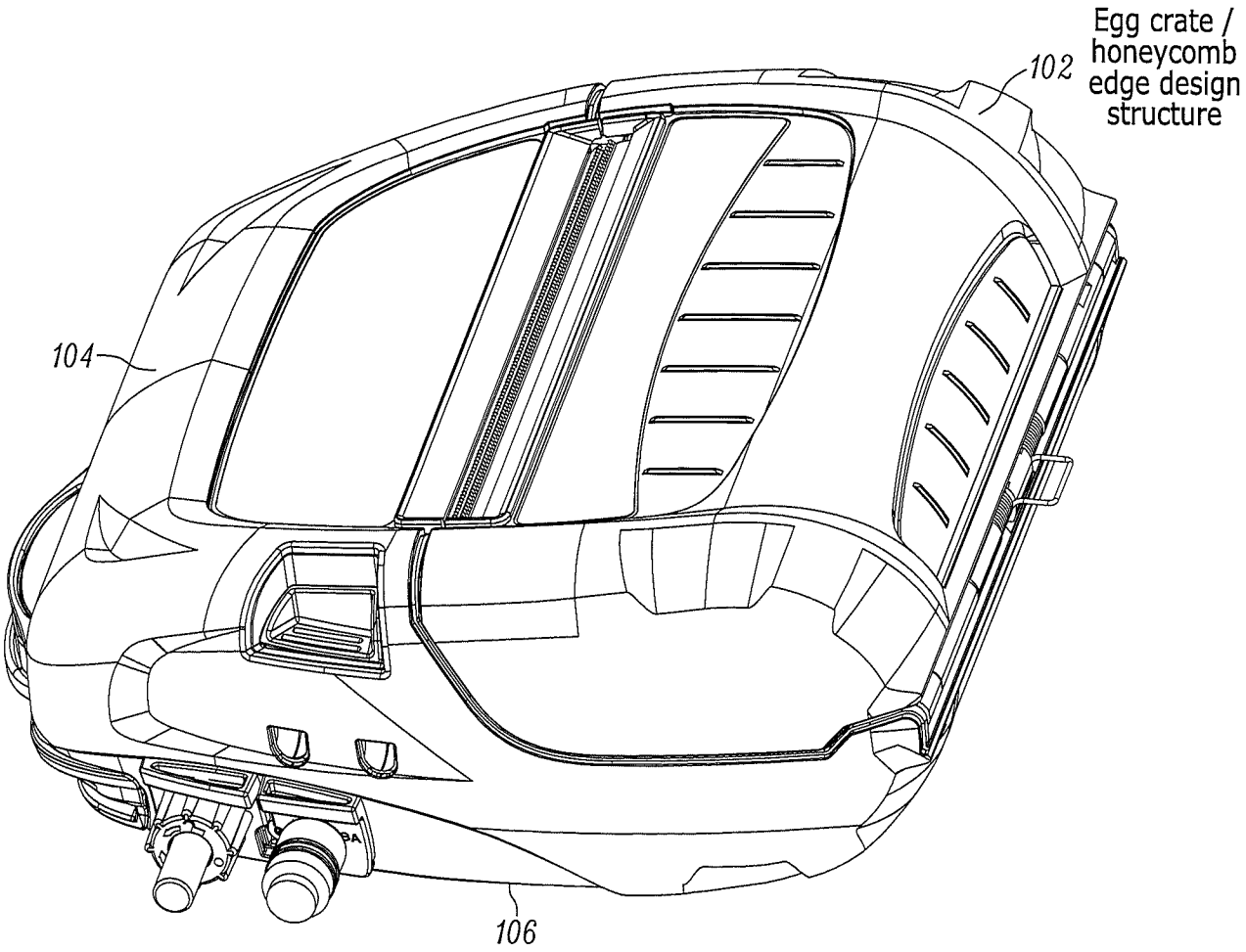
Figure 1C:
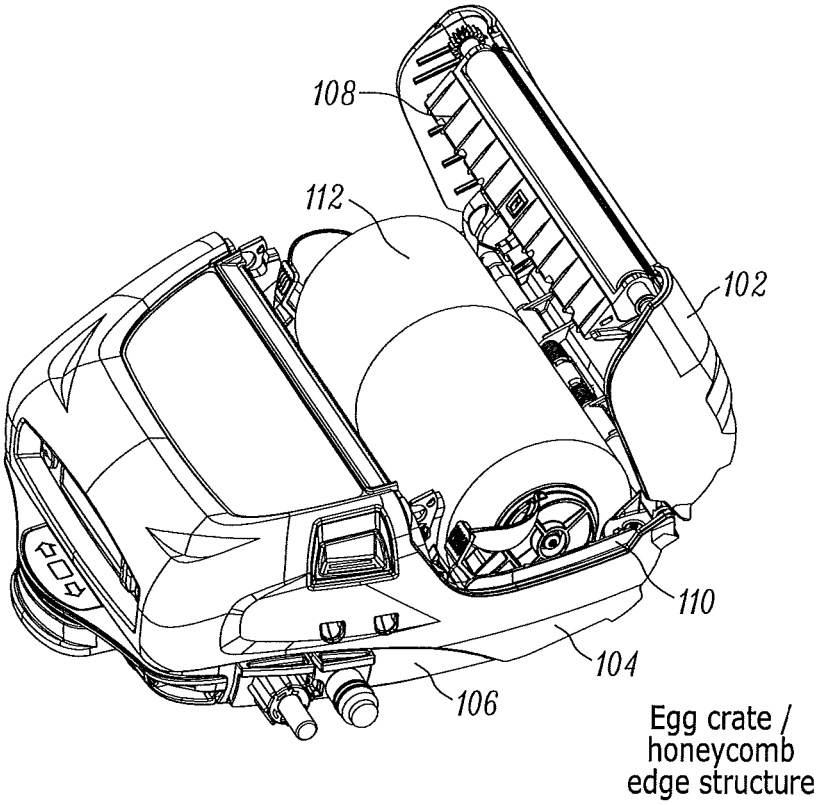
Figure 2A:
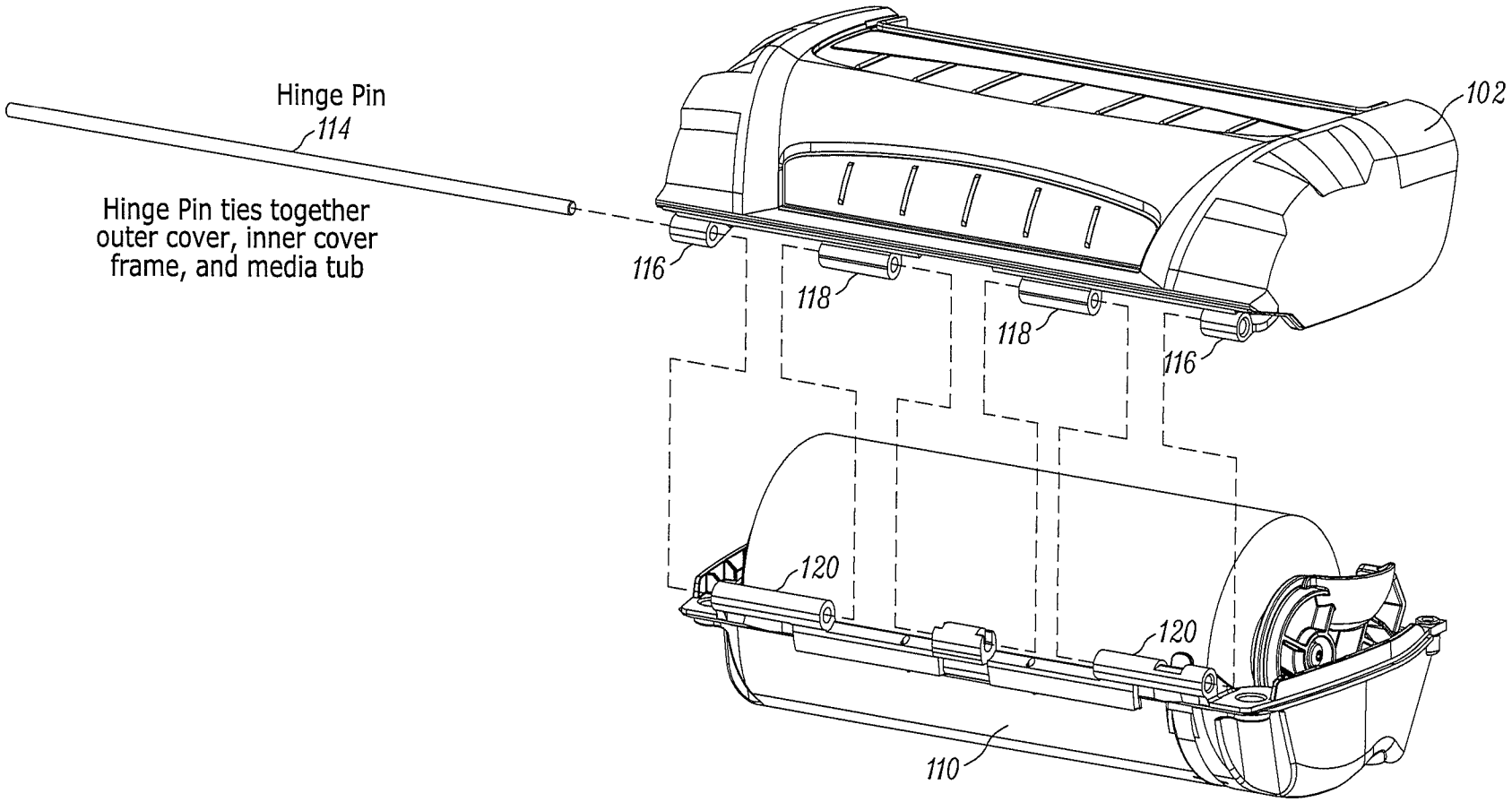
Figure 2B:
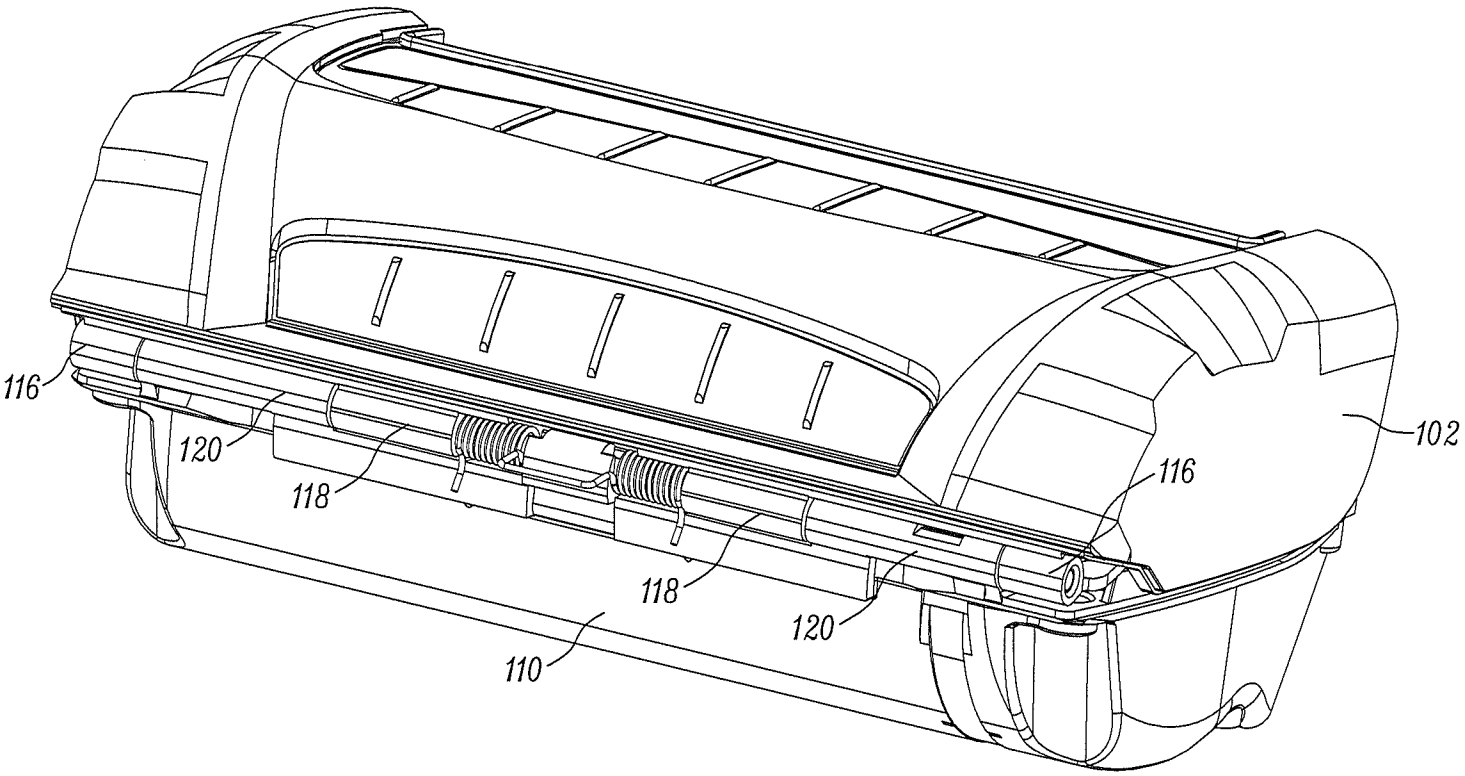
Figure 3A:
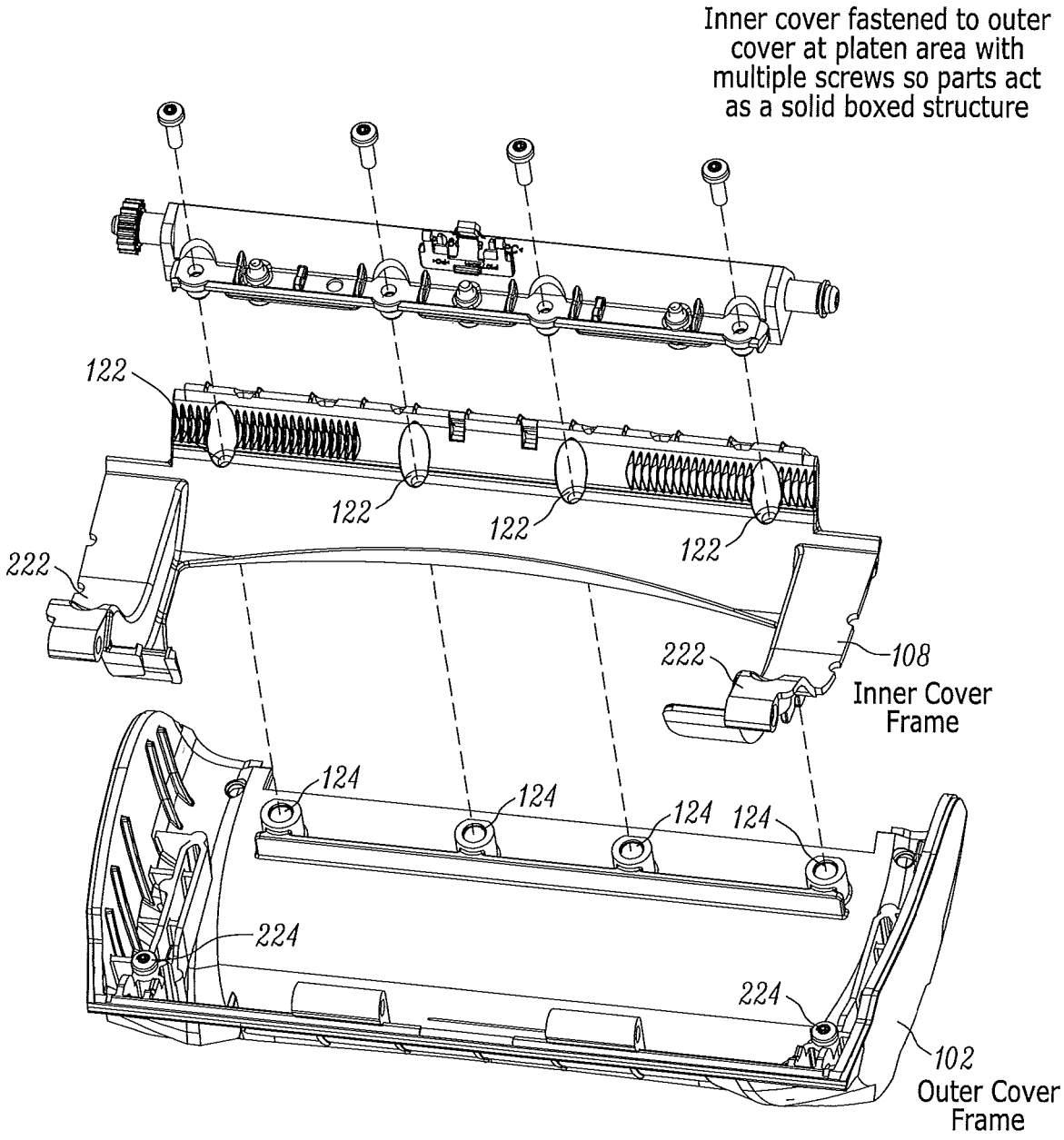
Figure 3B:
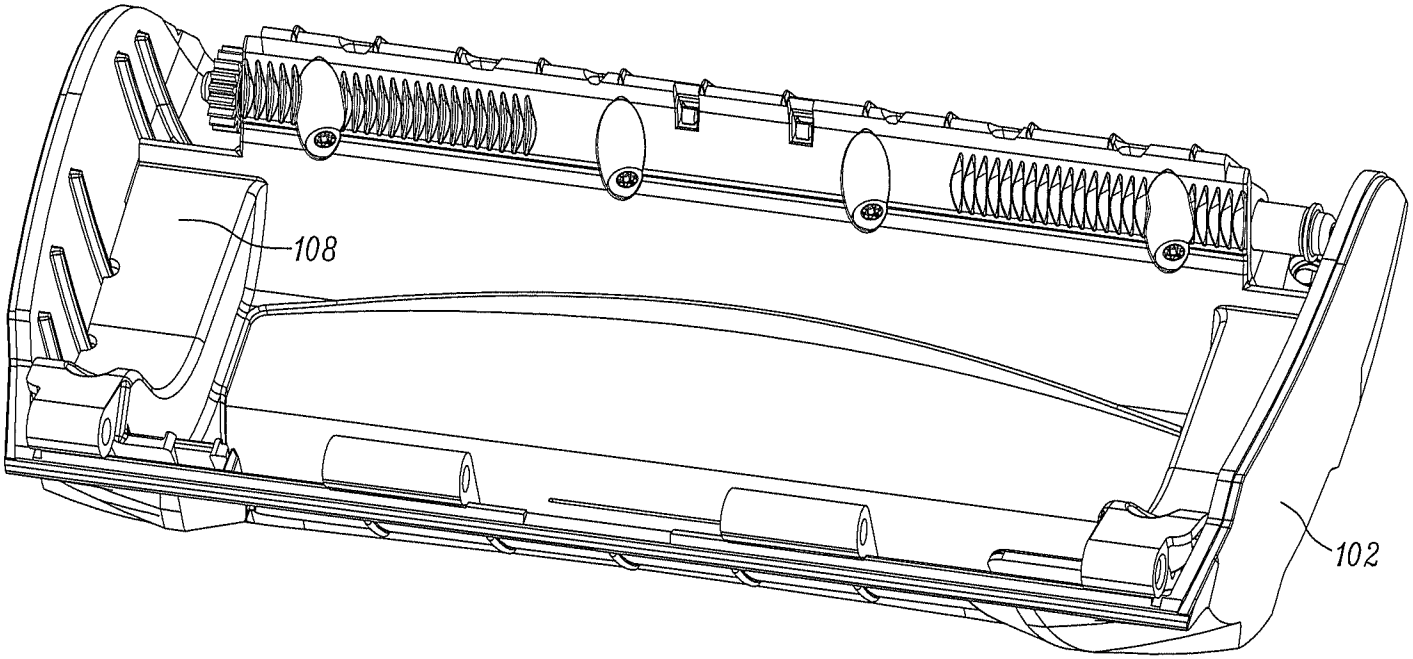
Figure 4:
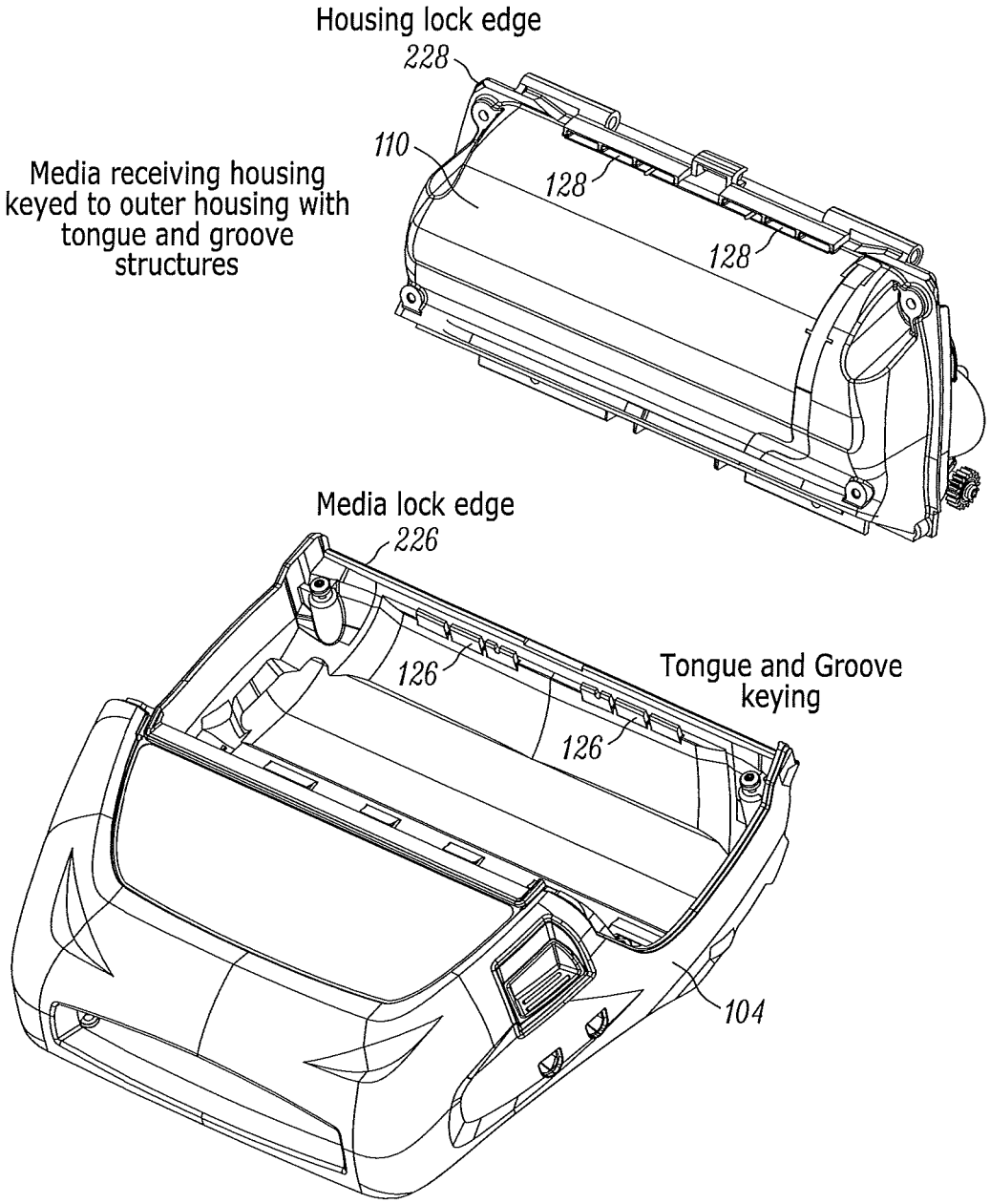
Figure 5A:
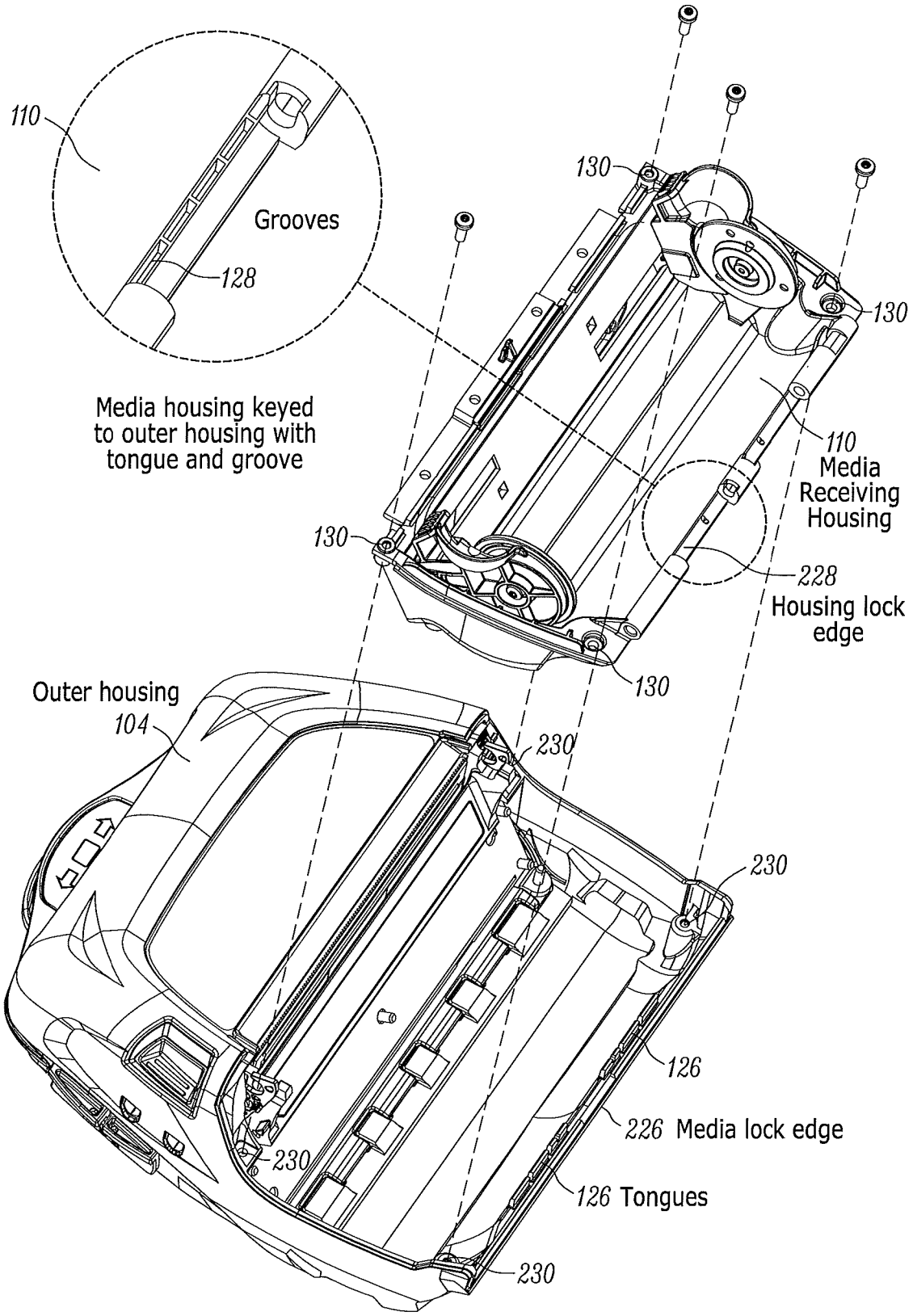
Figure 5B:
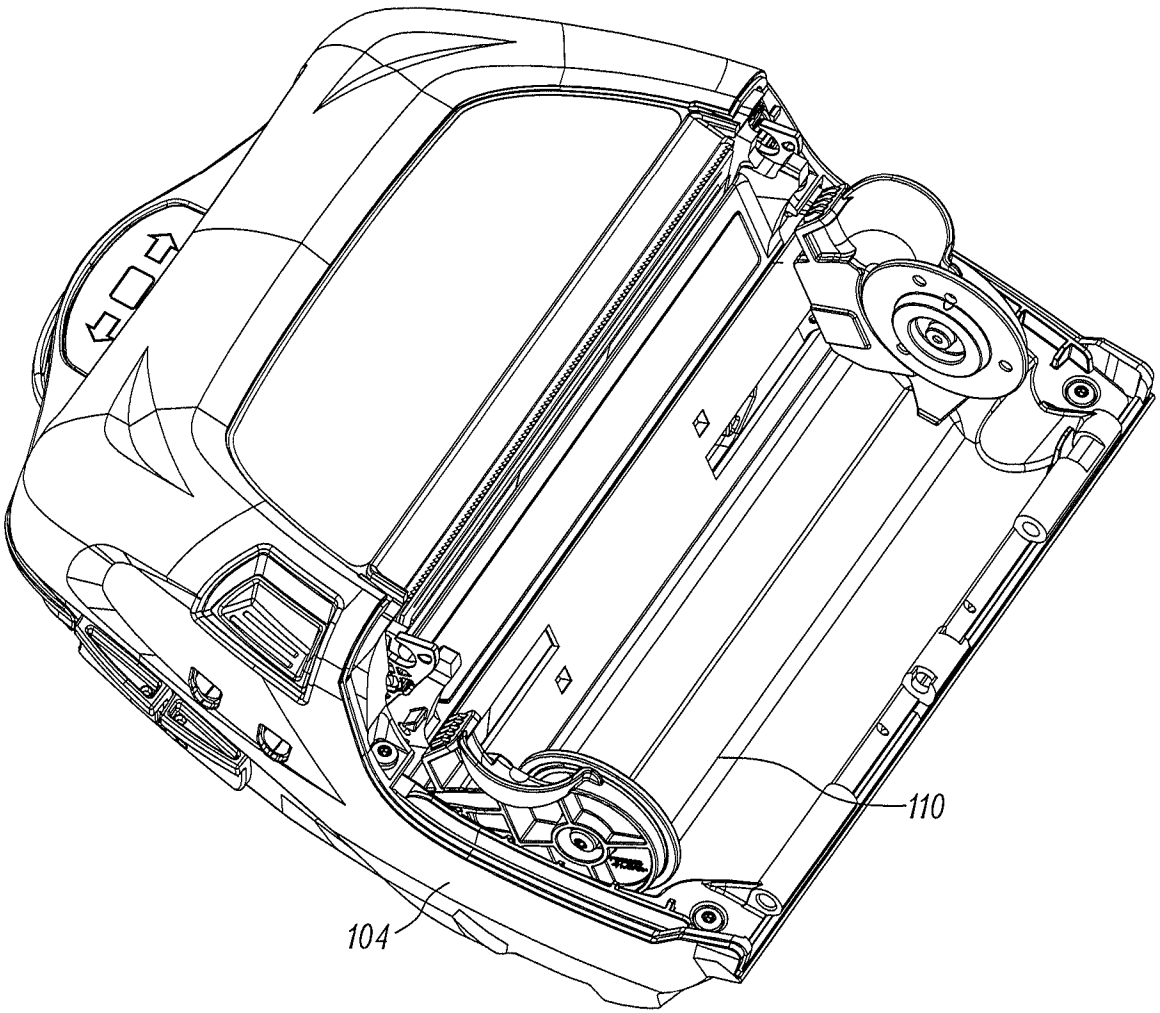
Figure 6A:
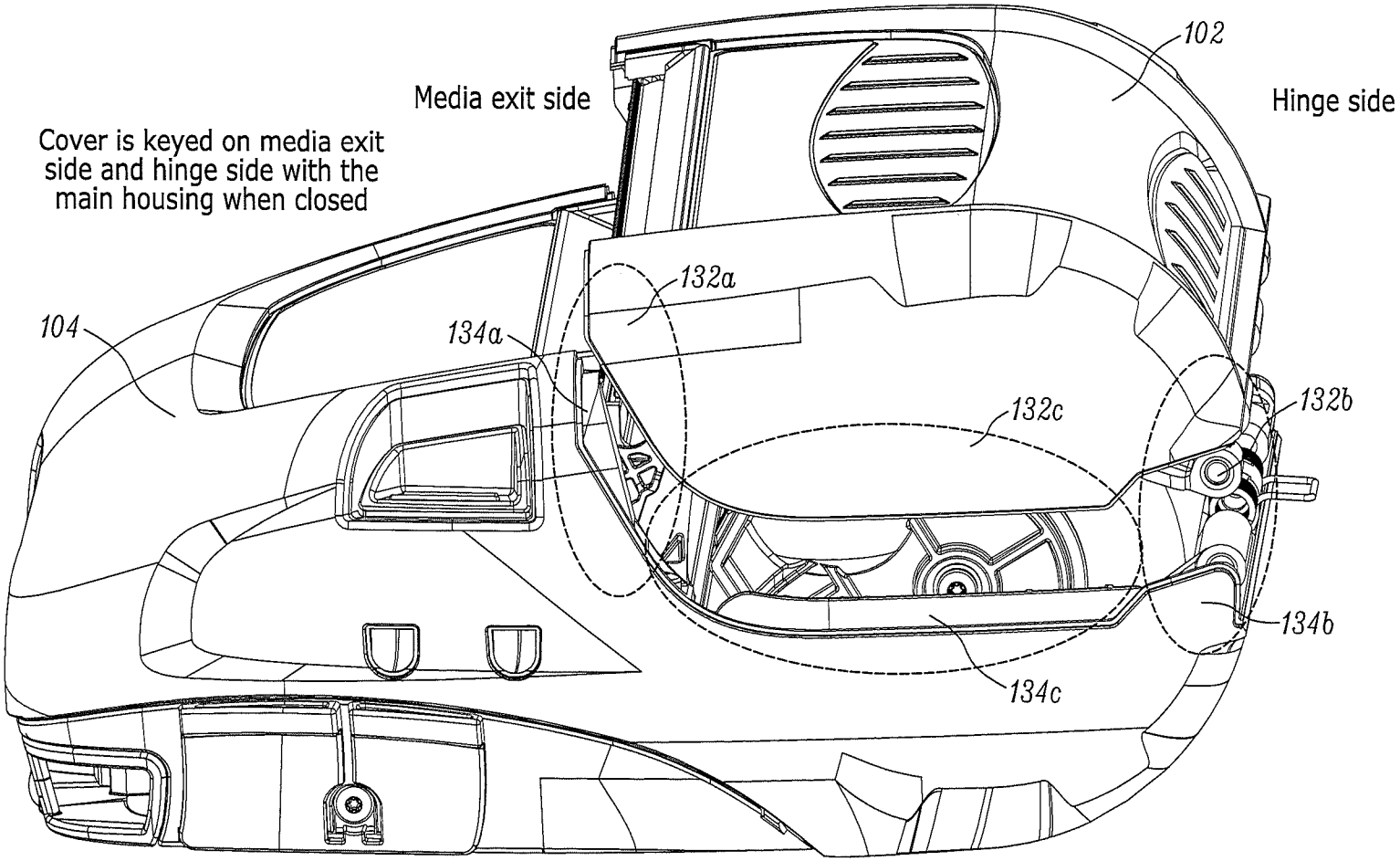
Figure 6B:
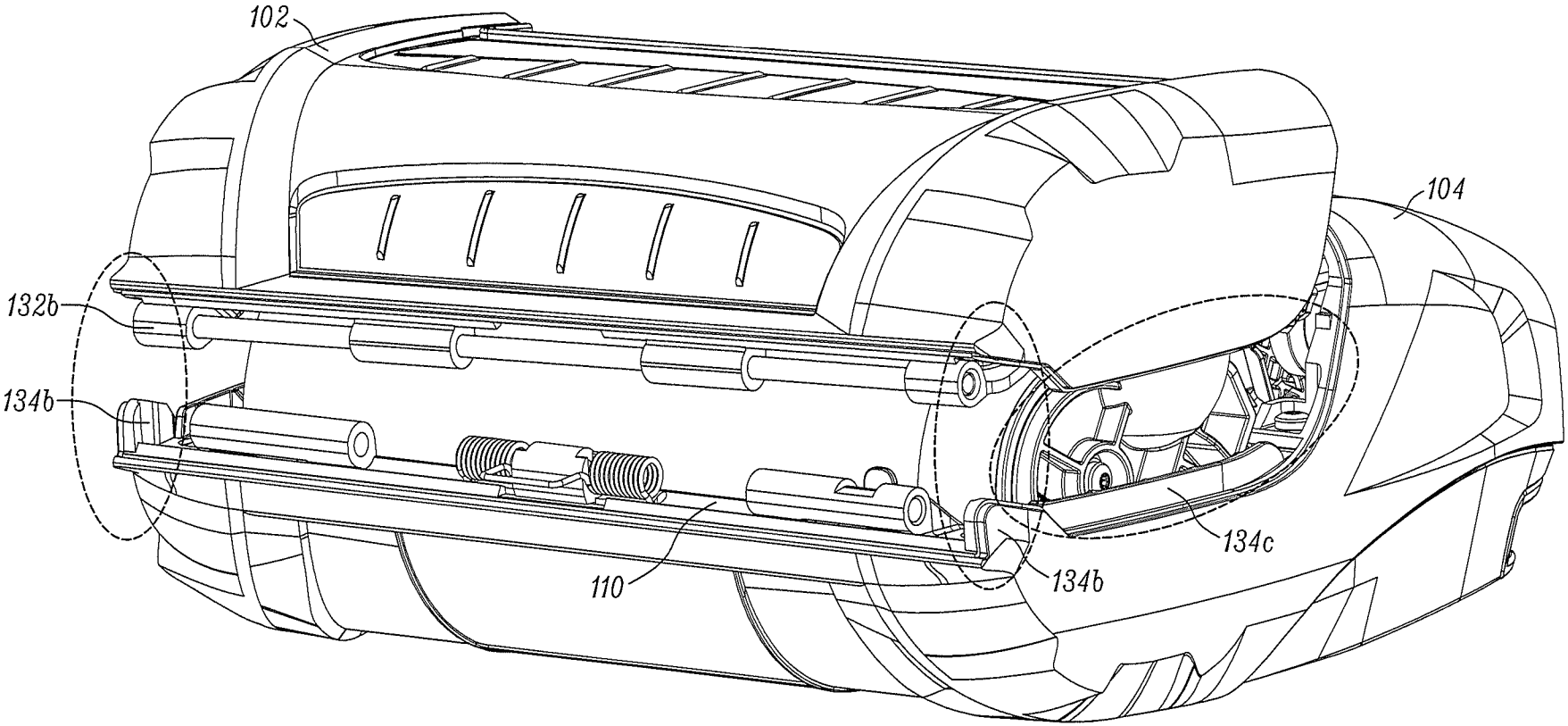
Figure 7:
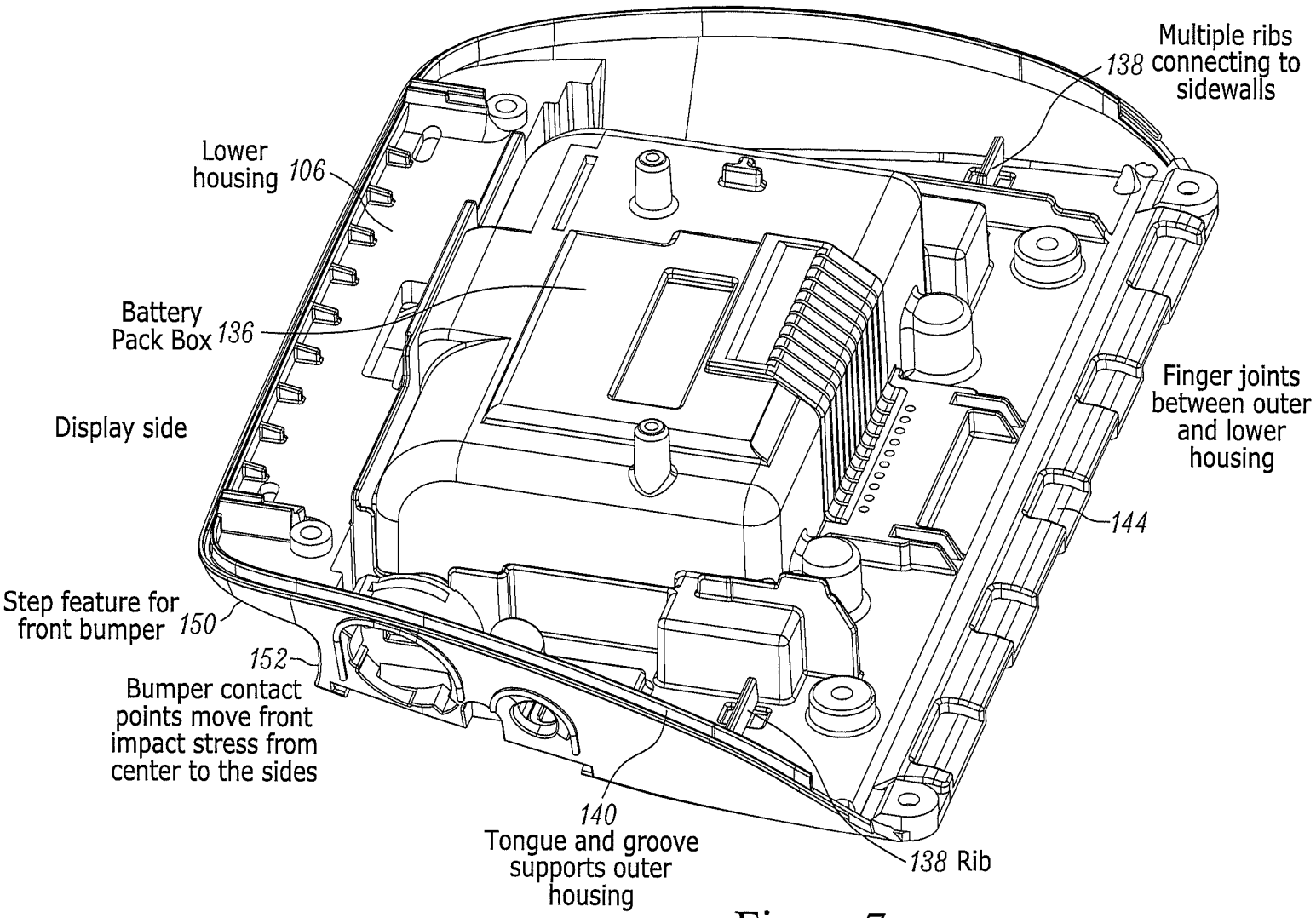
Figure 8A:
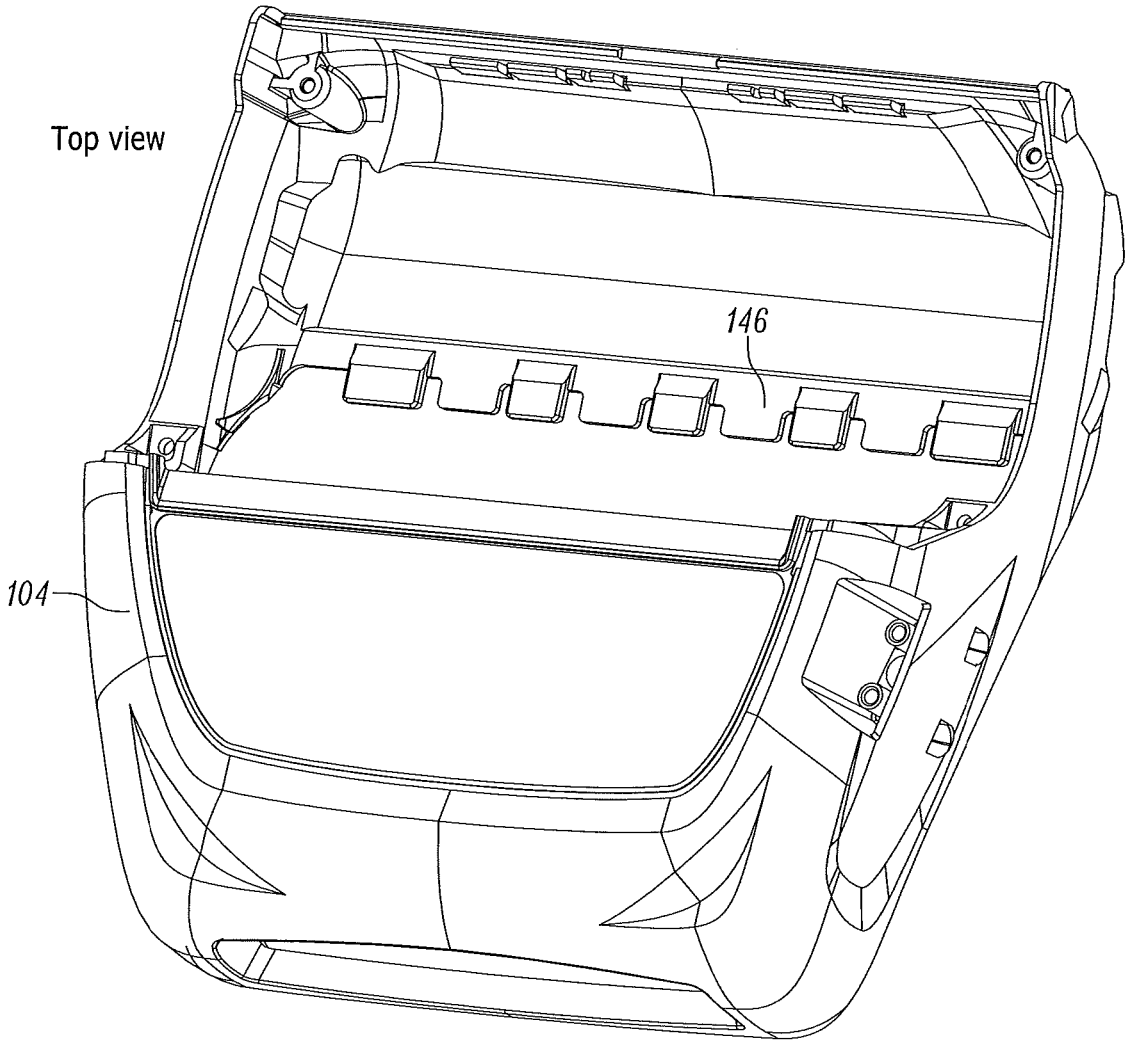
Figure 8B:
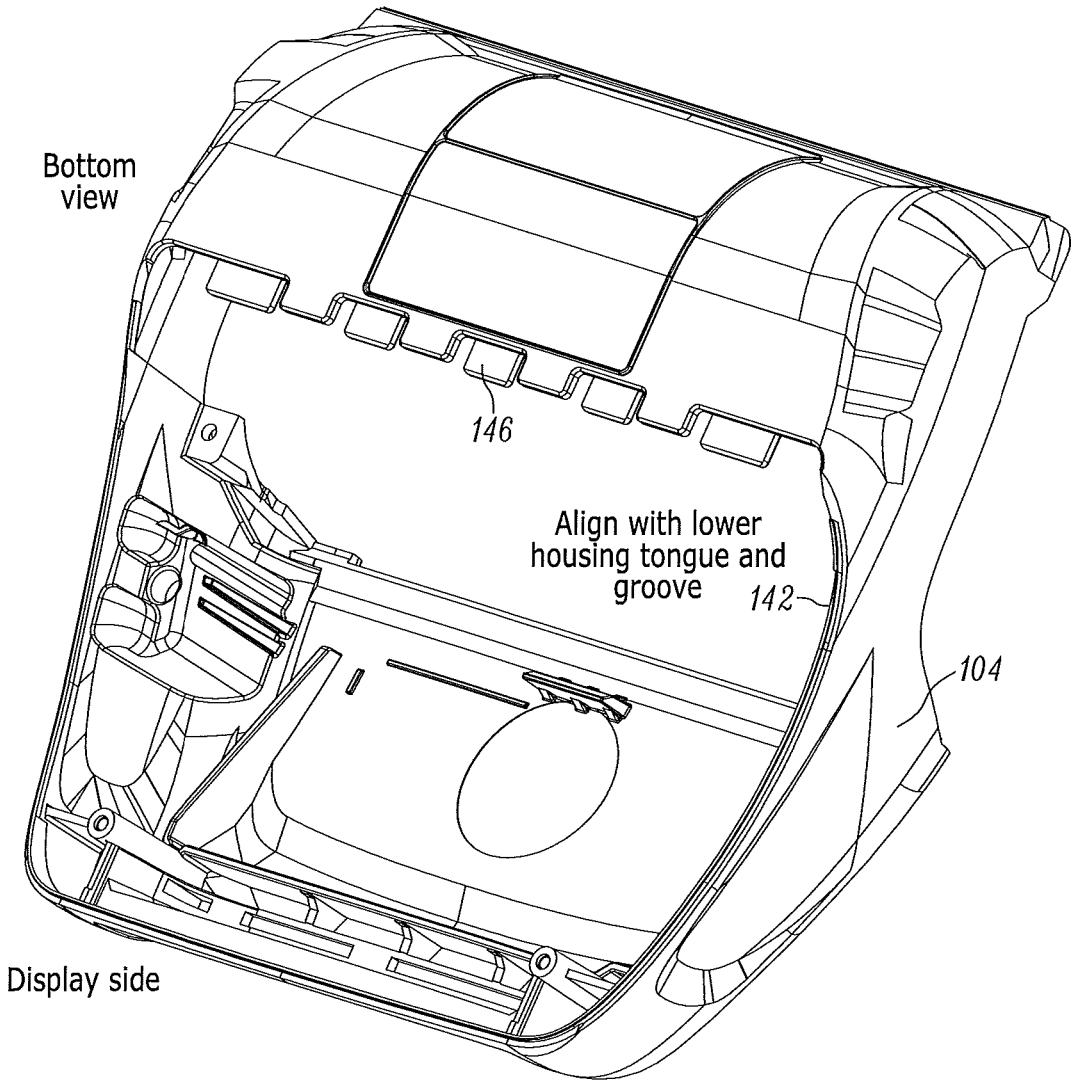
Figure 9:
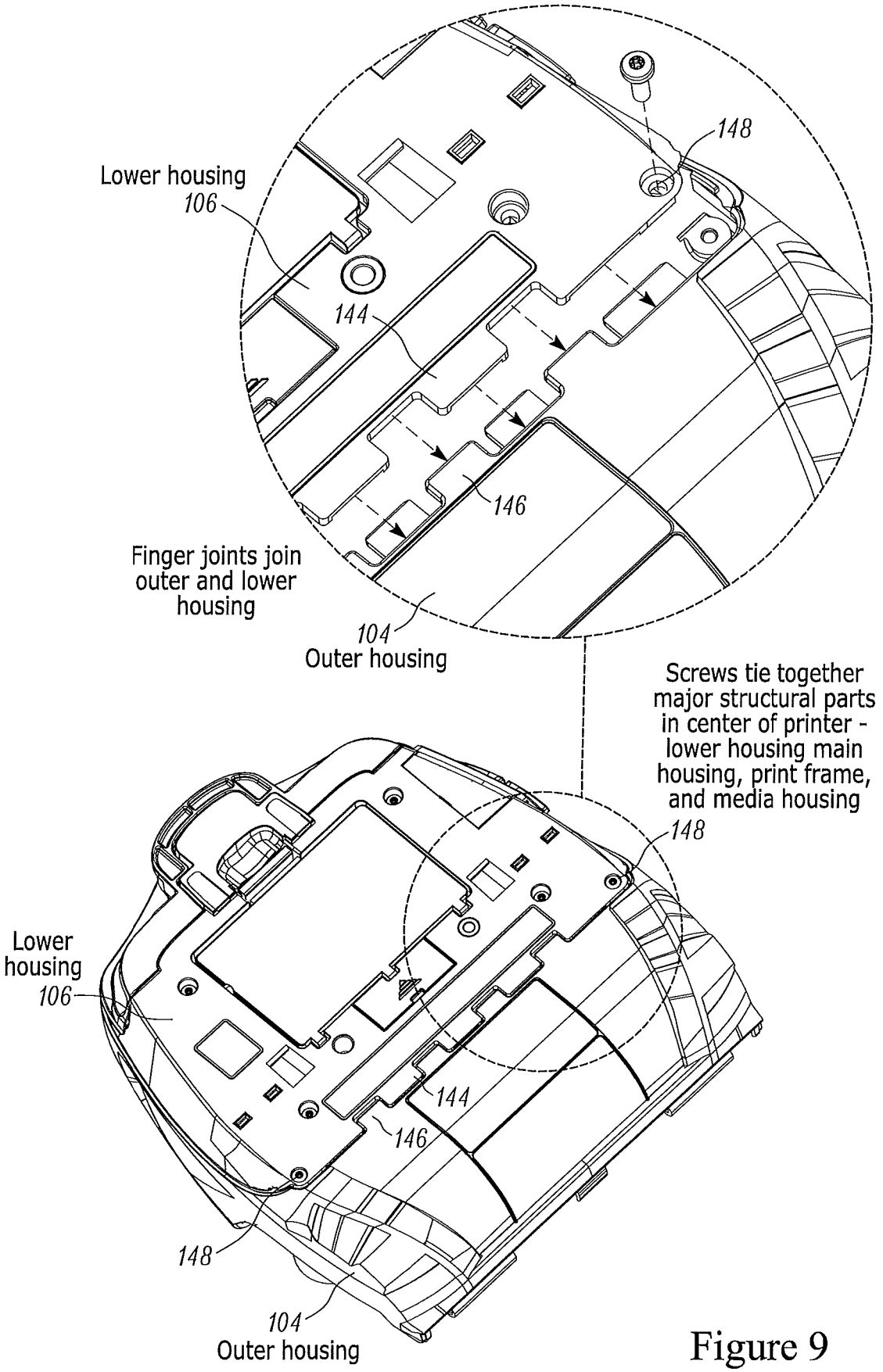
Figure 10:
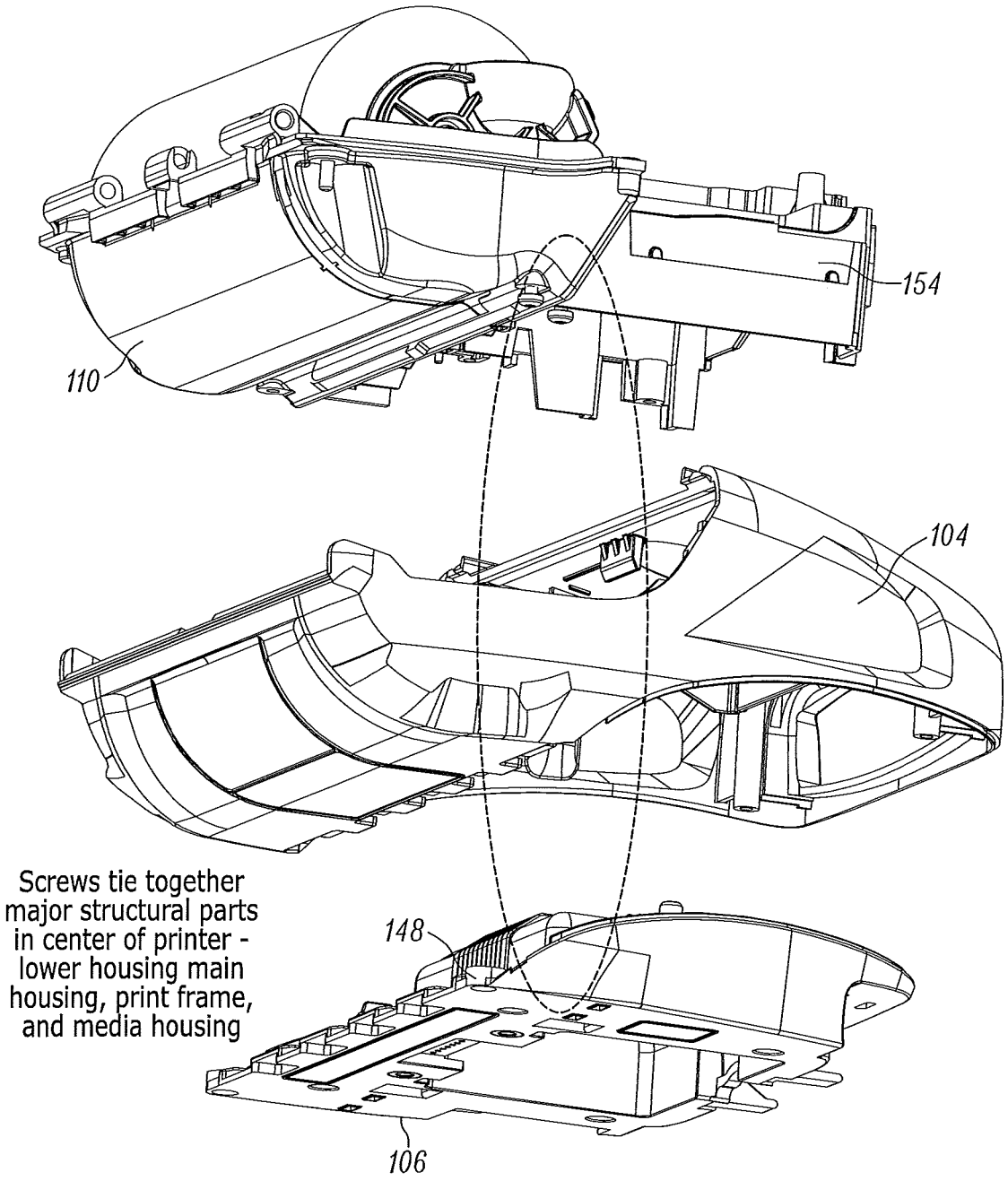
Figure 11:
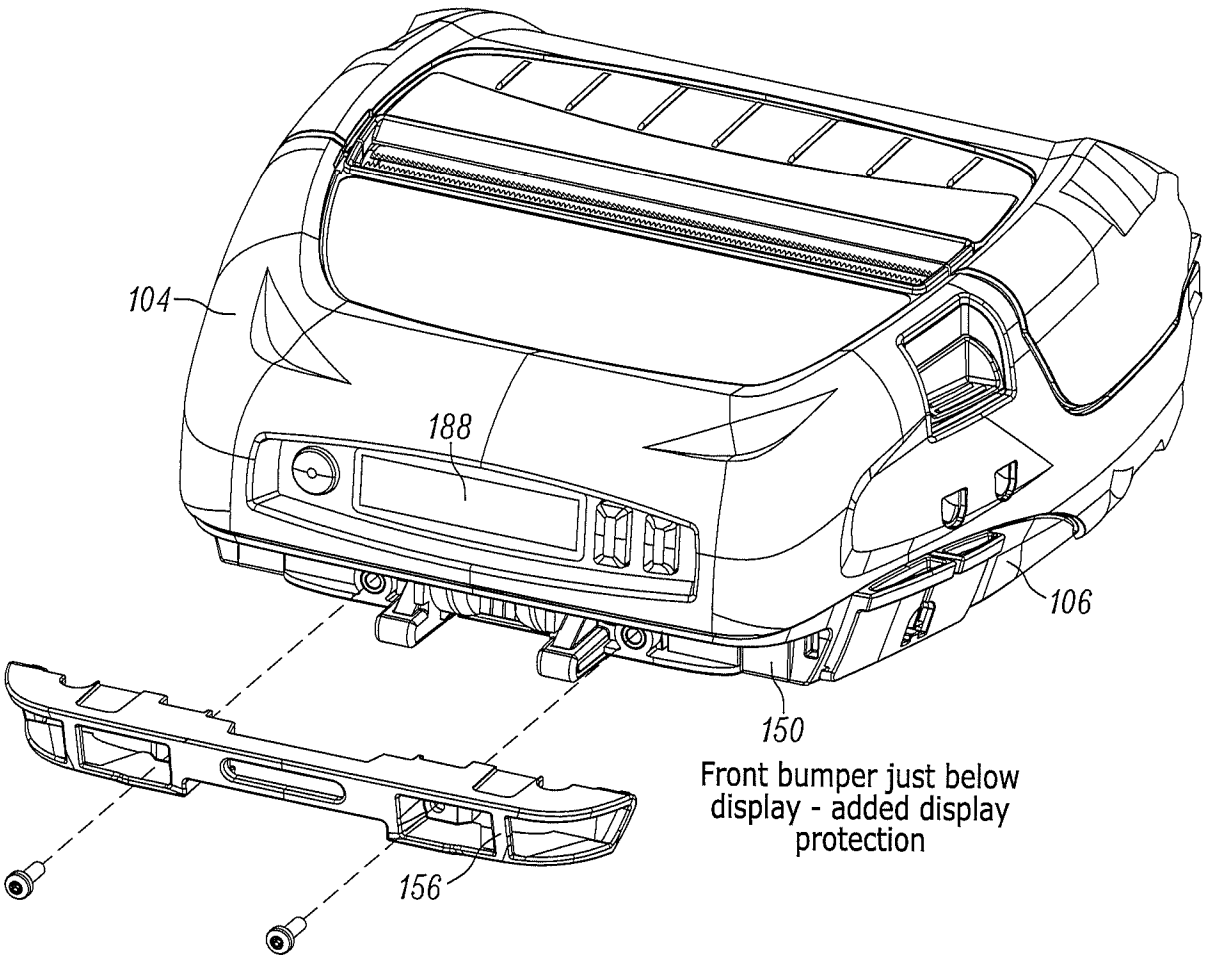
Figure 12A:
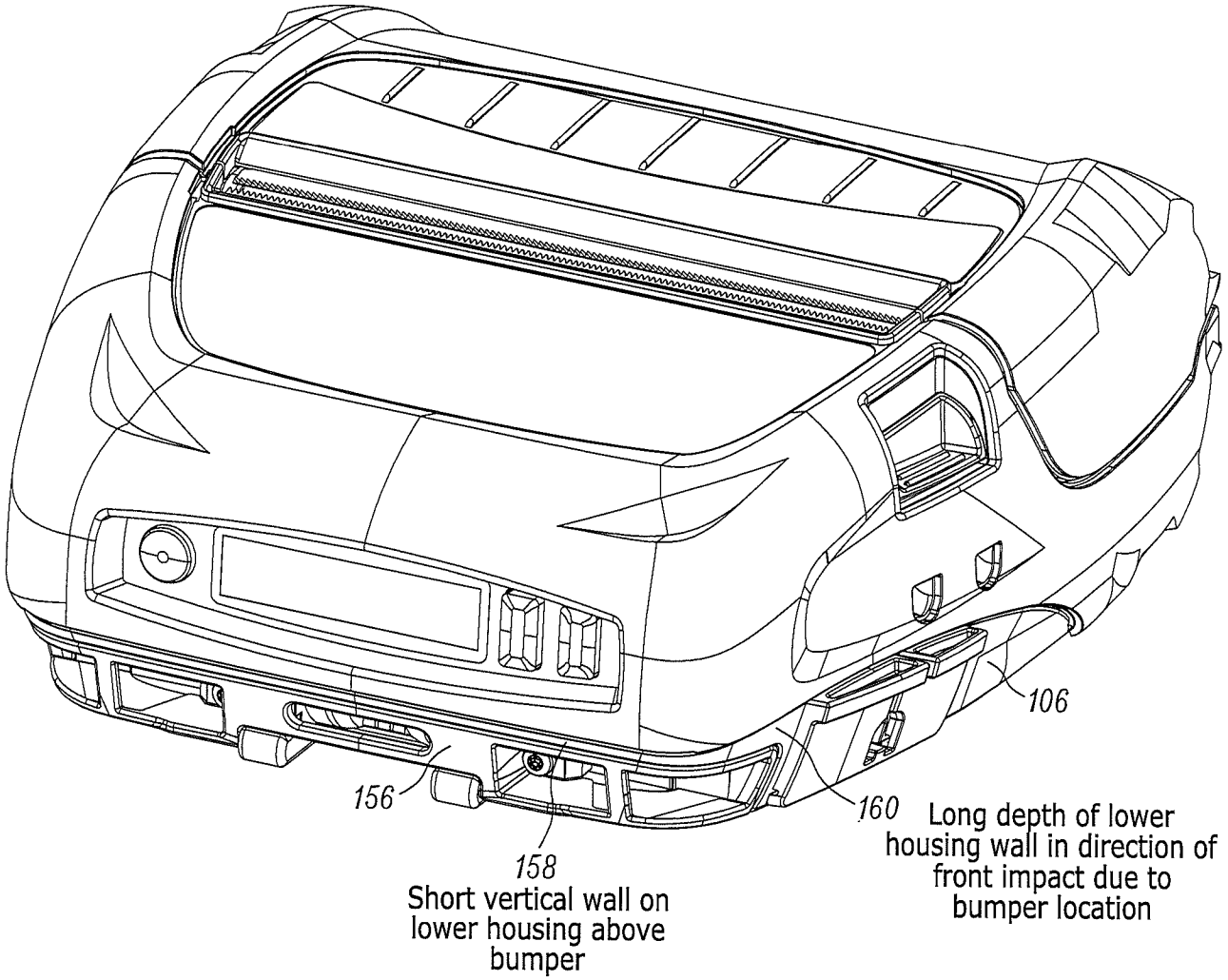
Figure 12B:
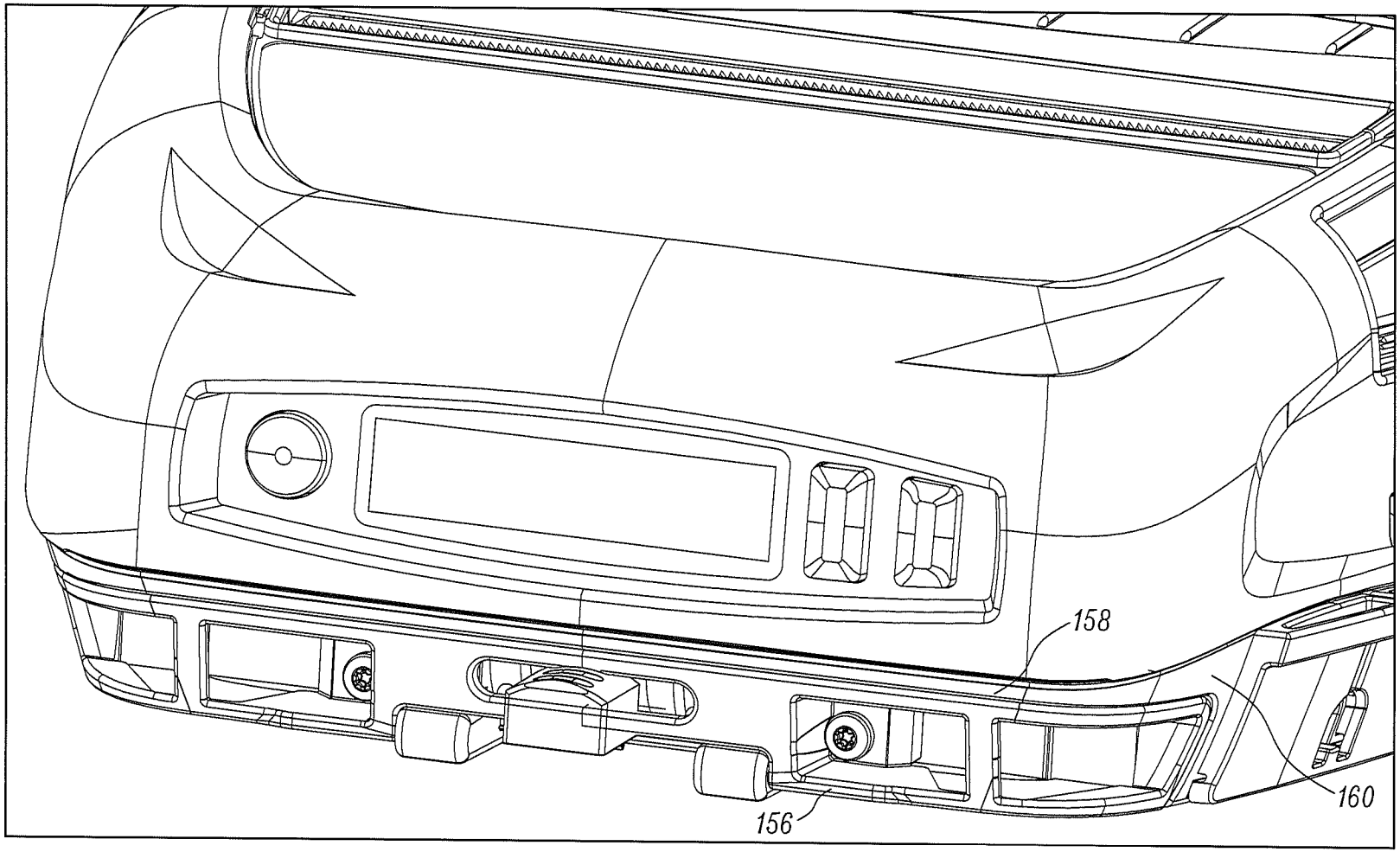
Figure 13:
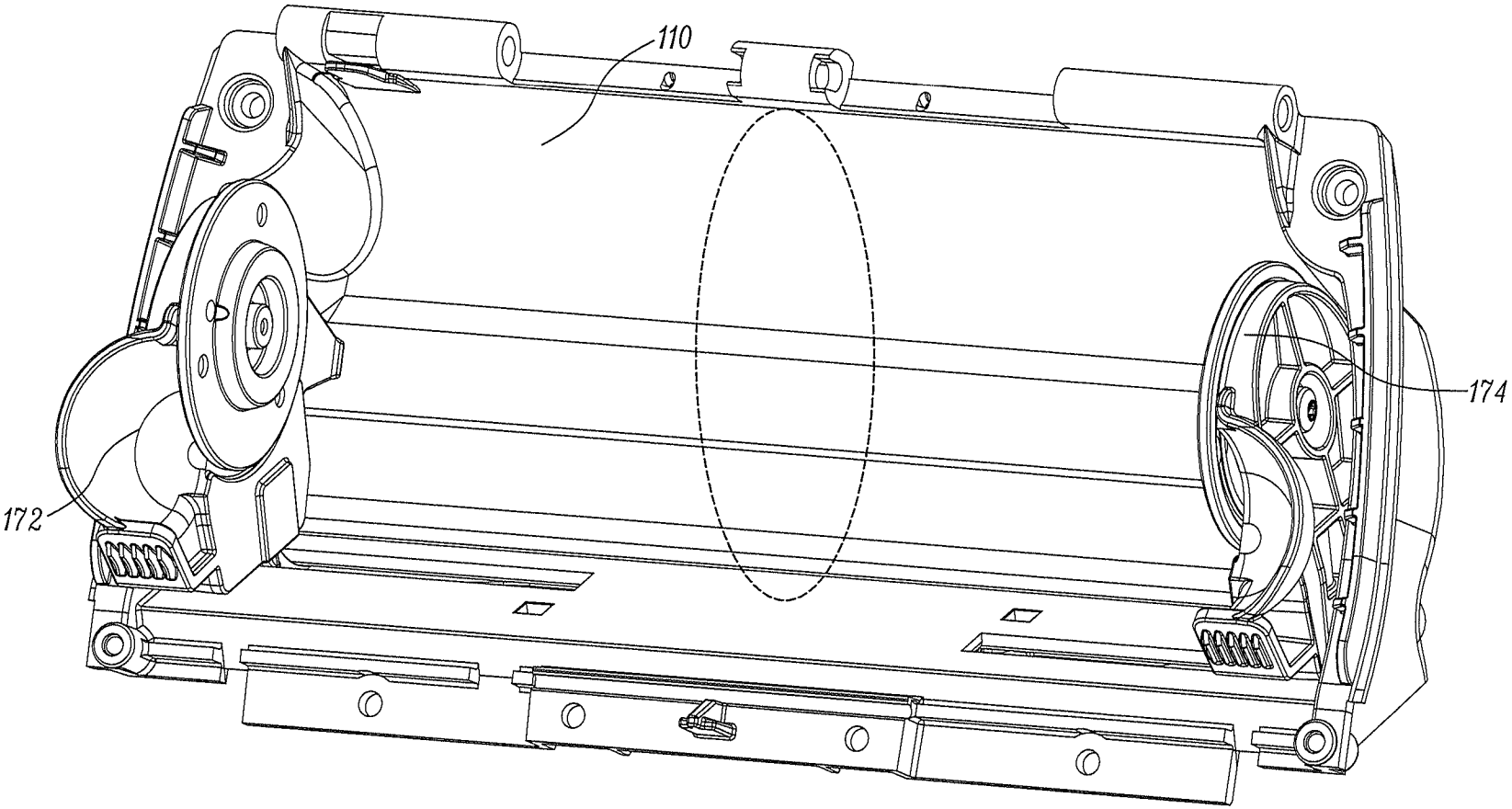
Figure 14:
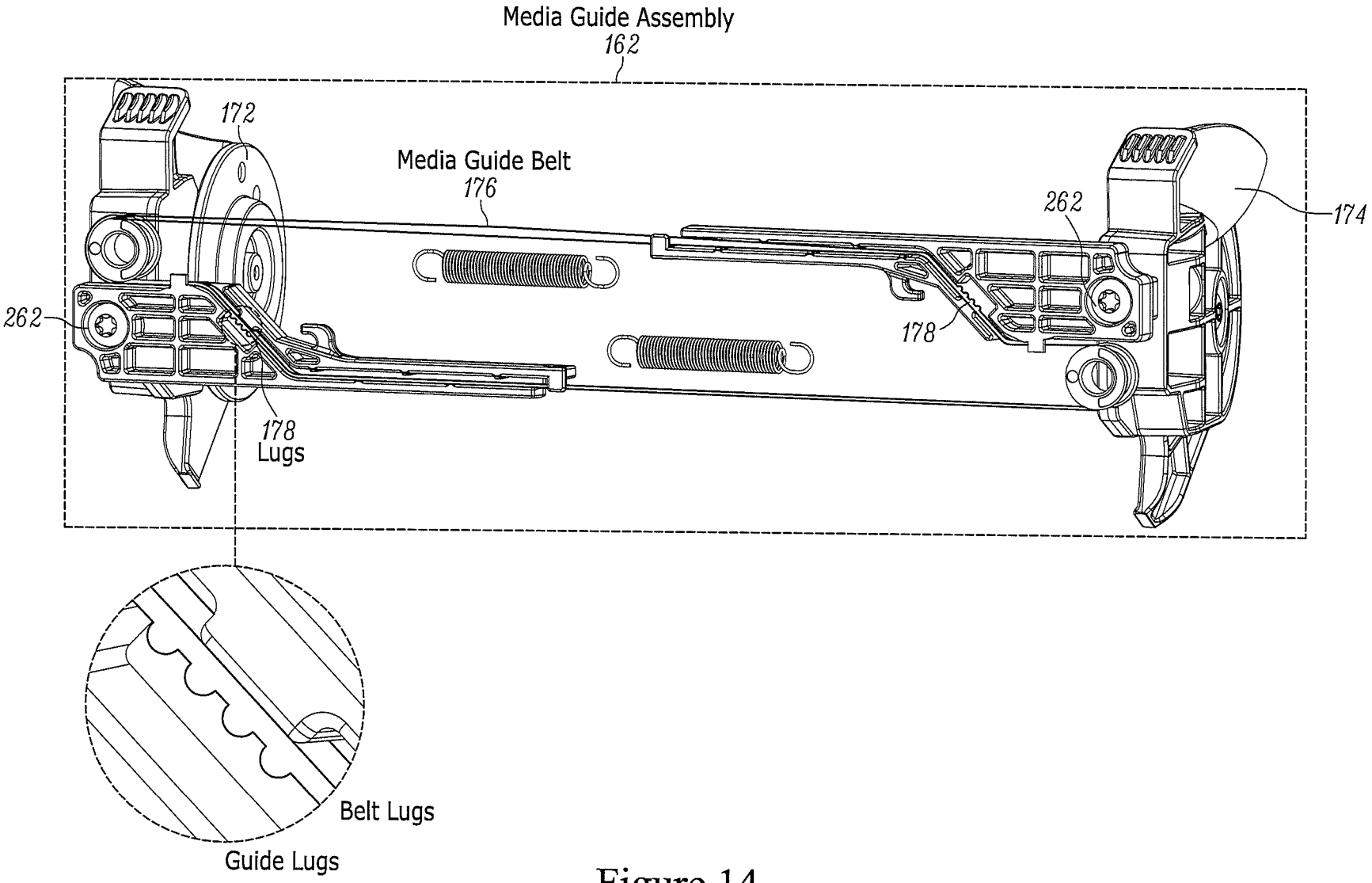
Figure 15:
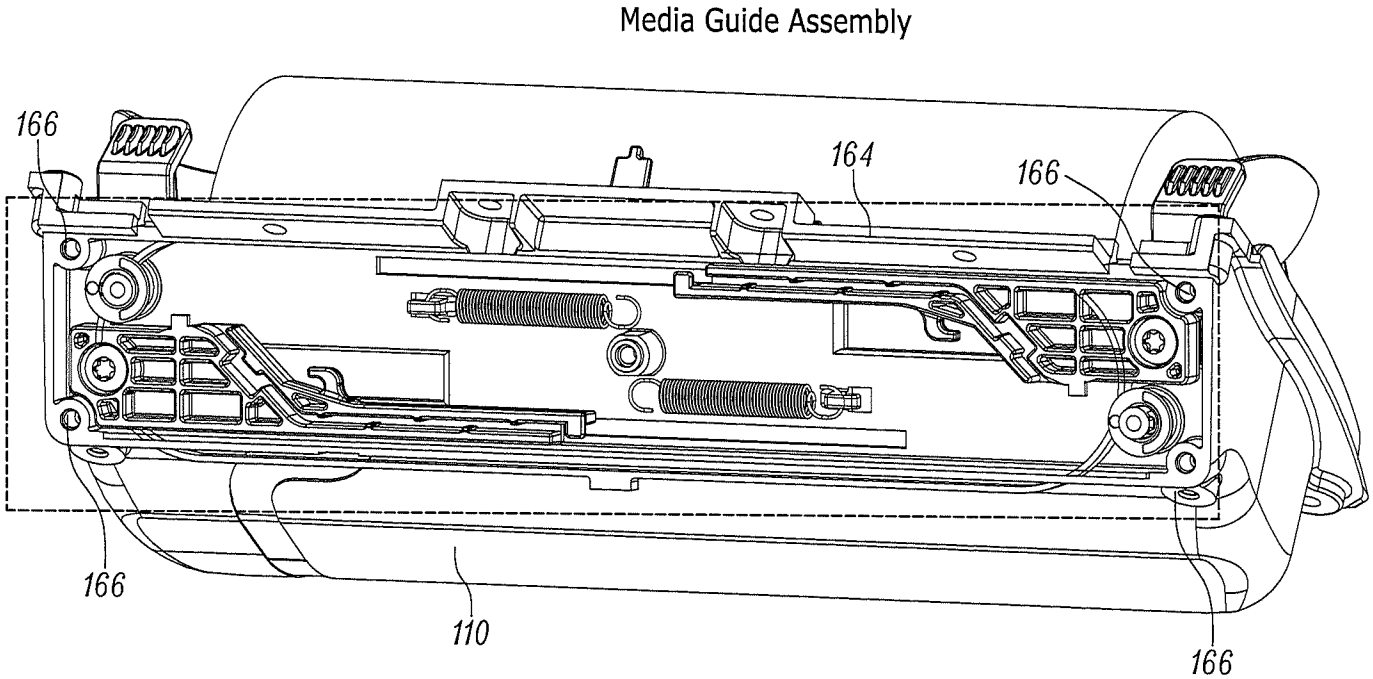
Figure 16:
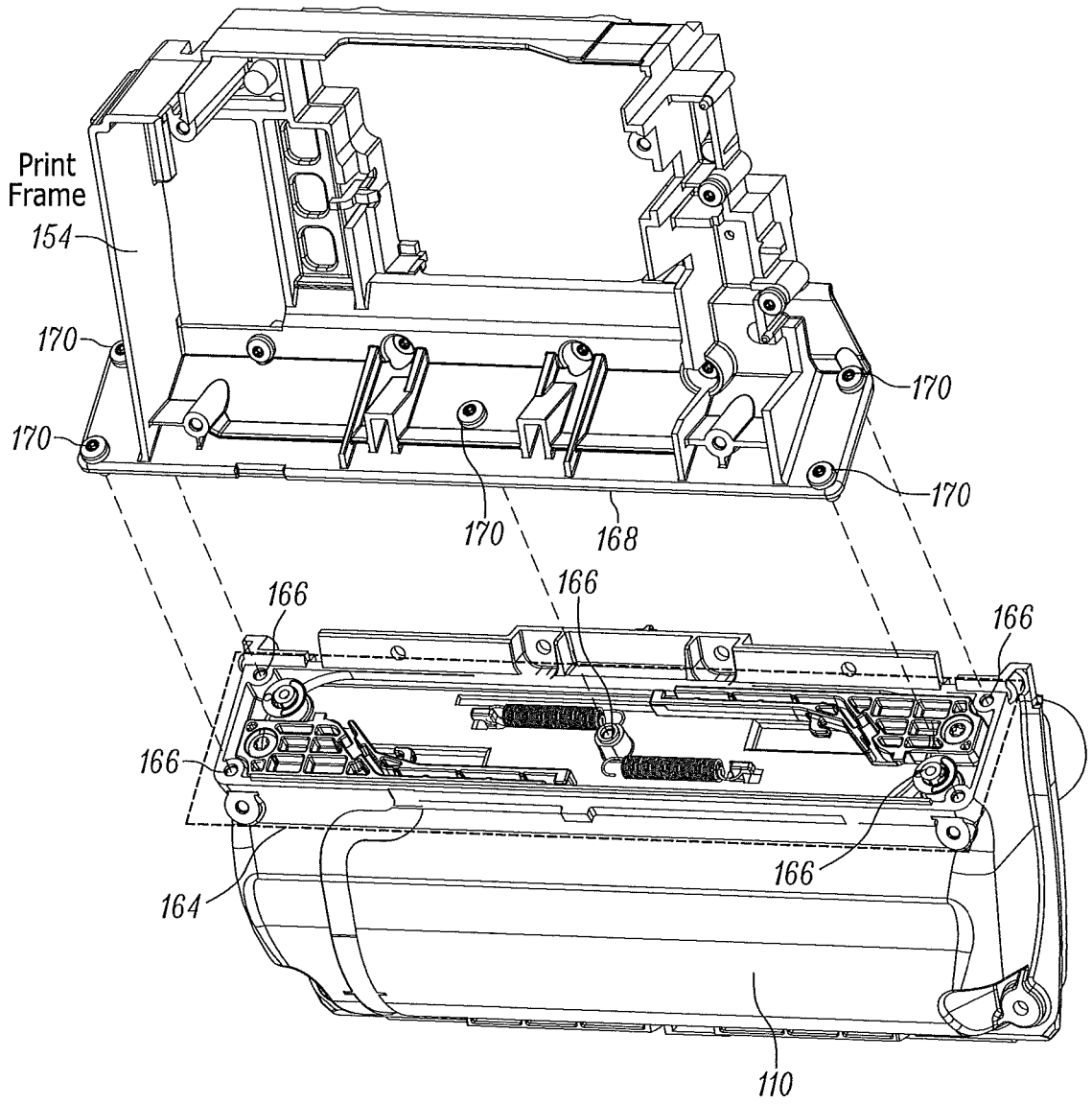
Figure 17:
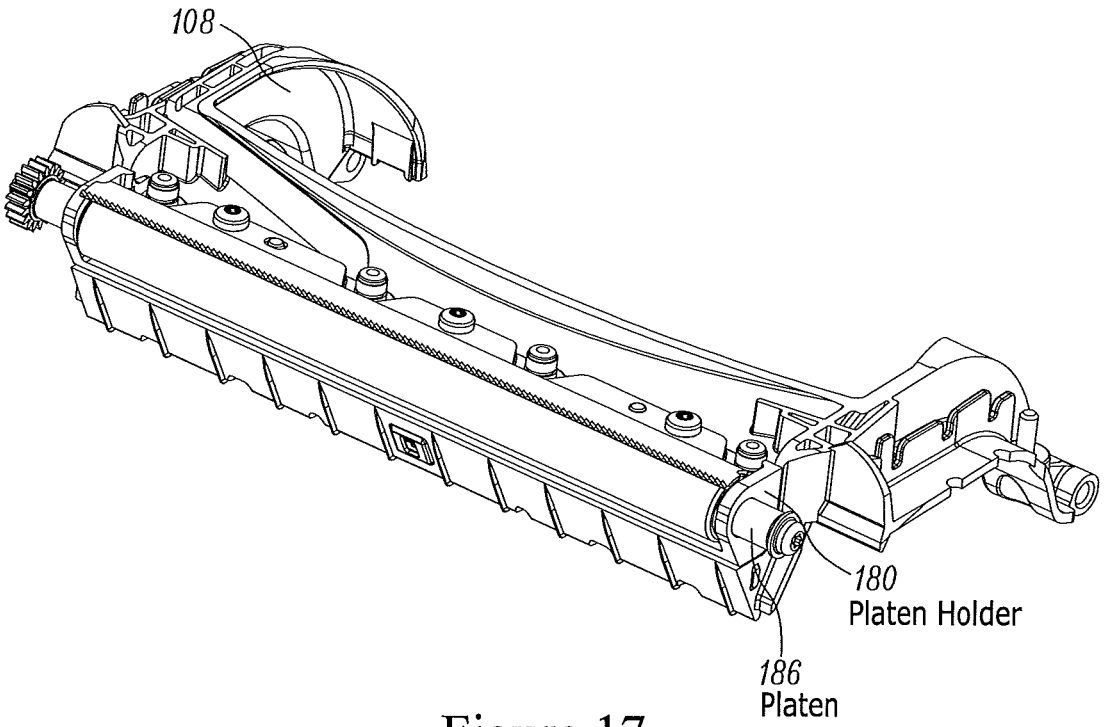
Figure 18A:
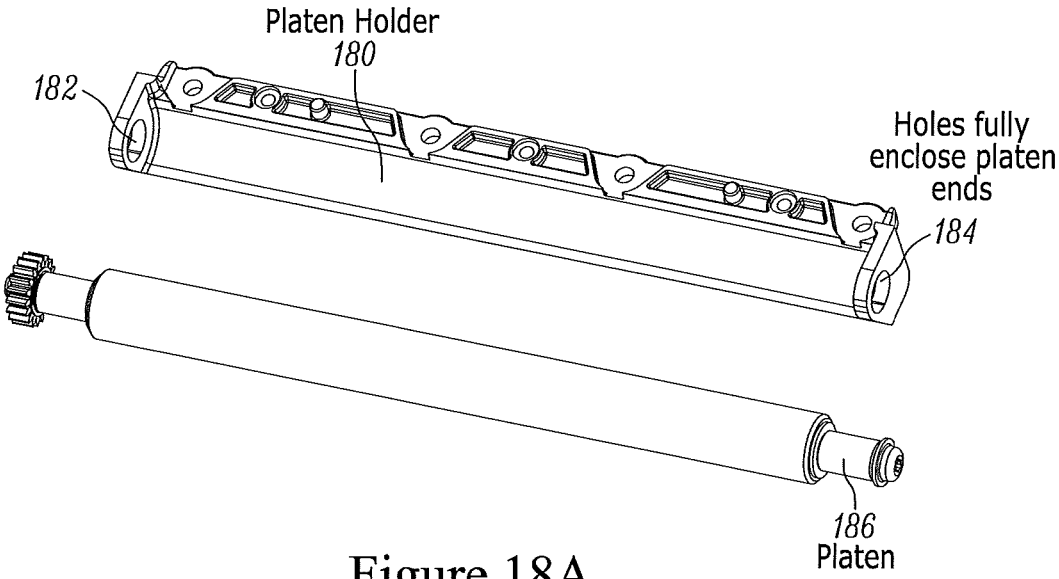
Figure 18B:
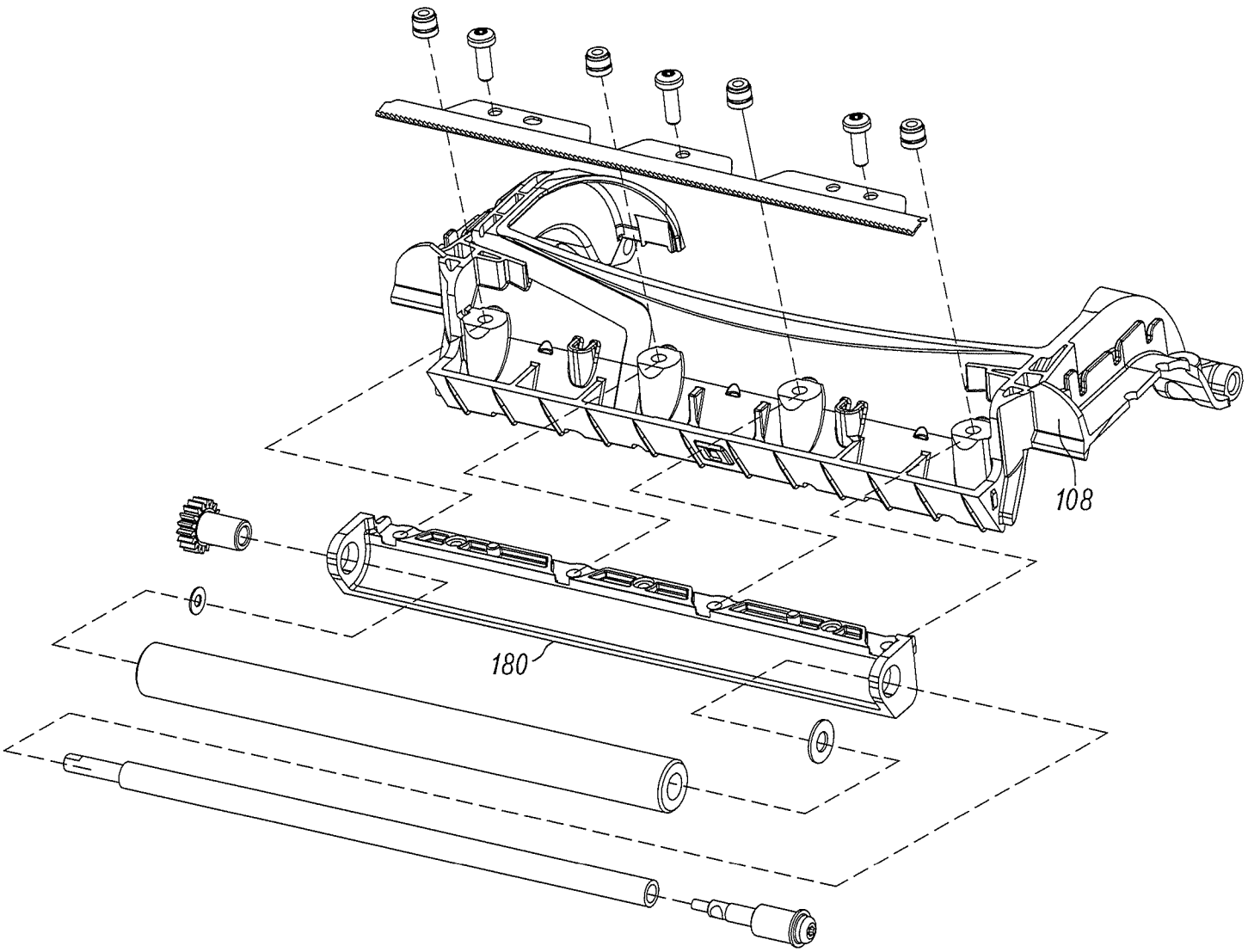
Figure 19:
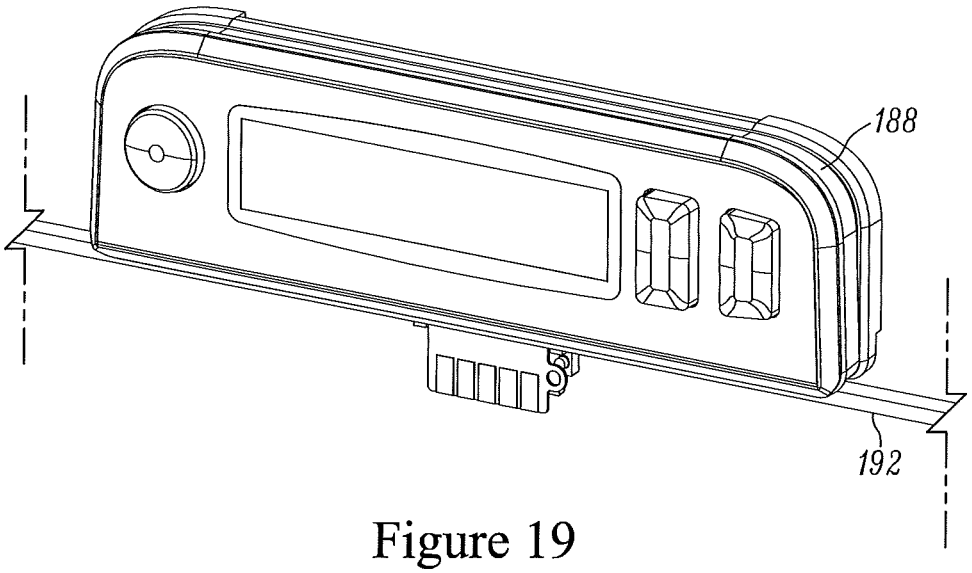
Figure 20:
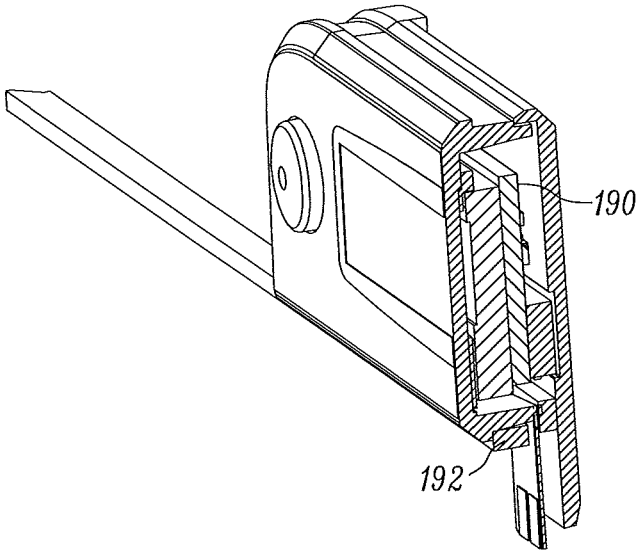
Figure 21:
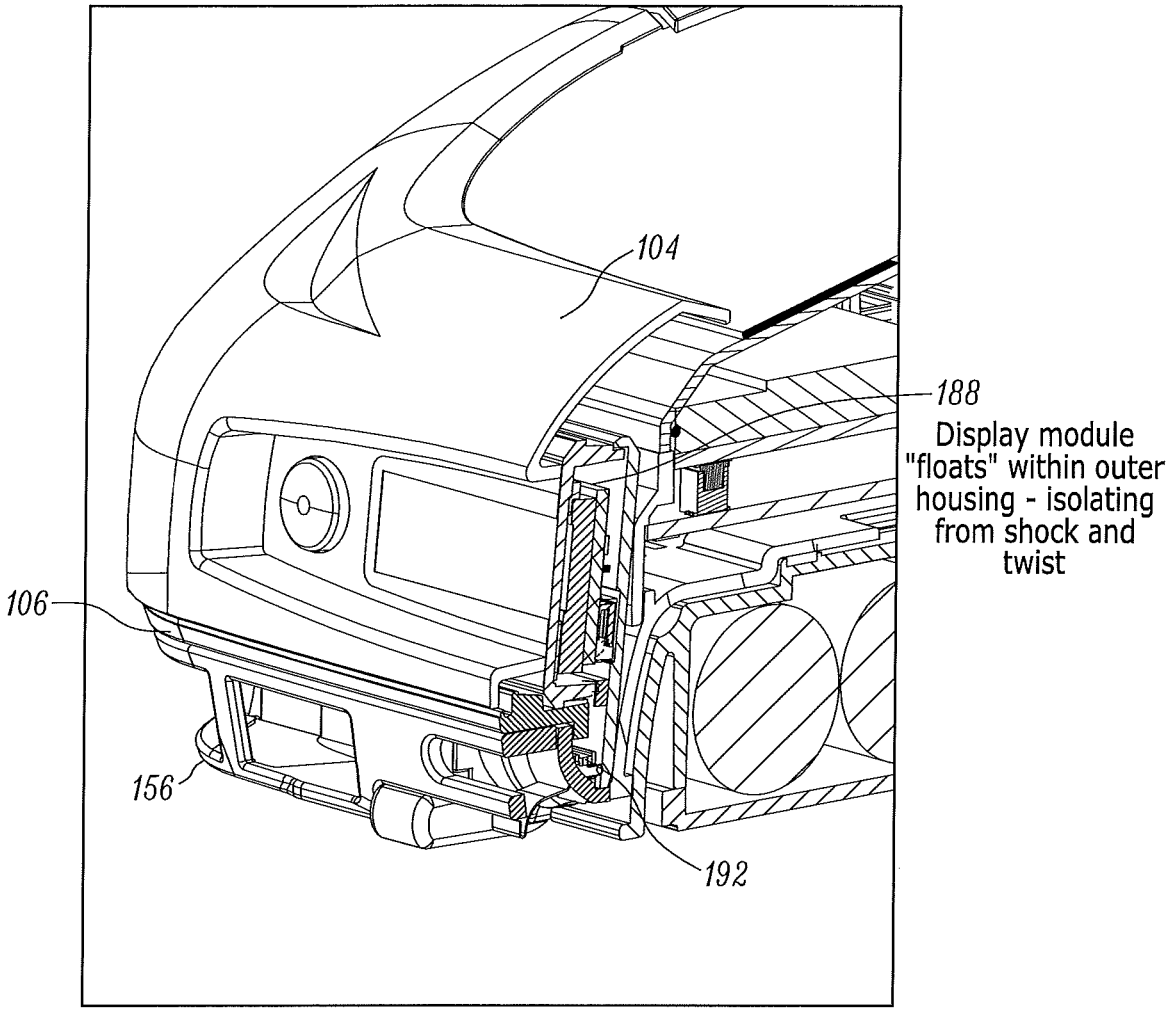
Figure 22A:
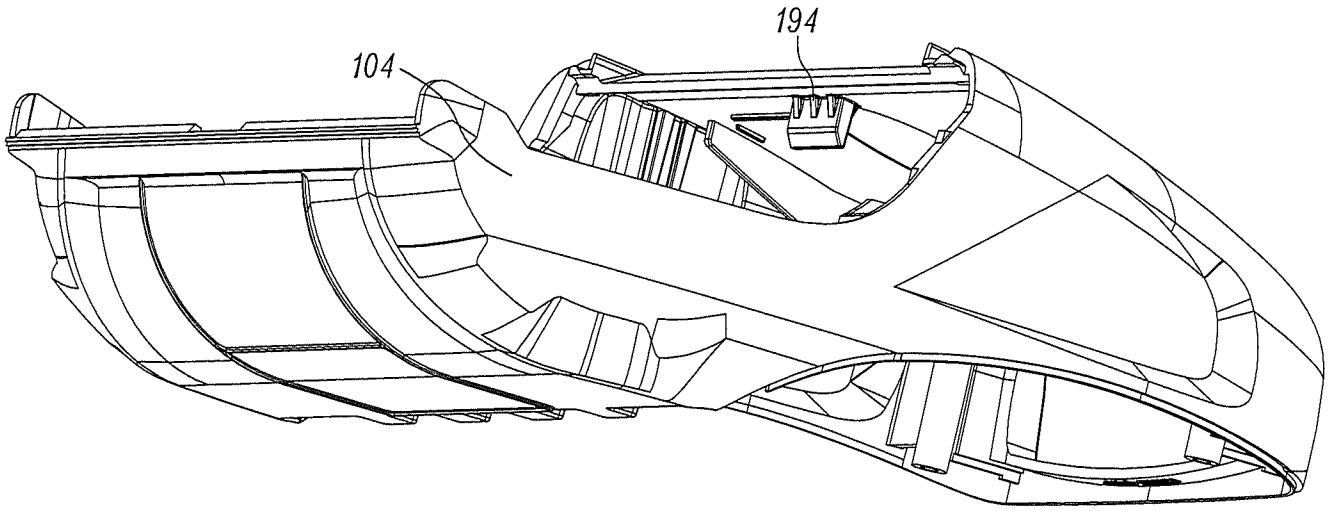
Figure 22B:
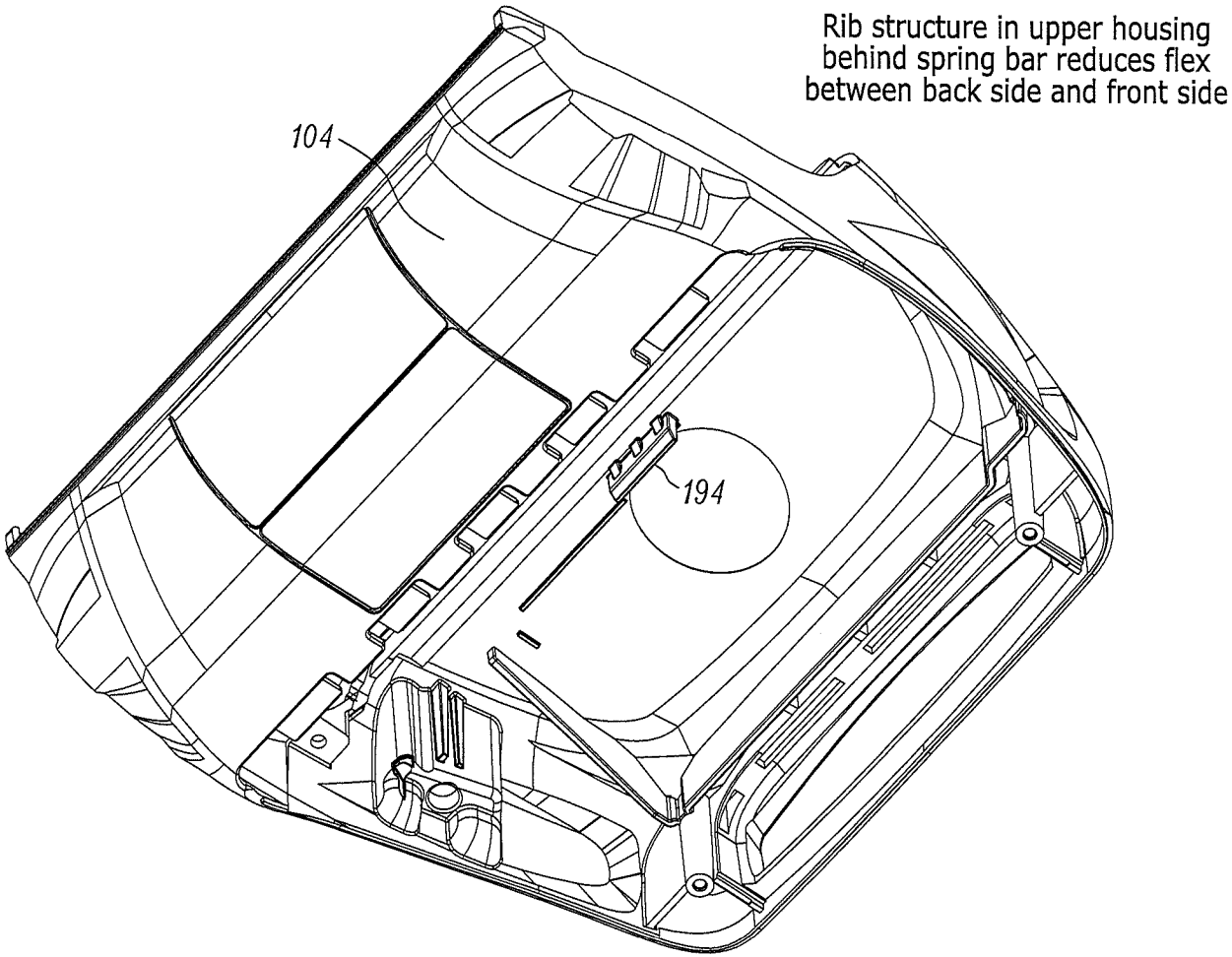
Figure 23A:
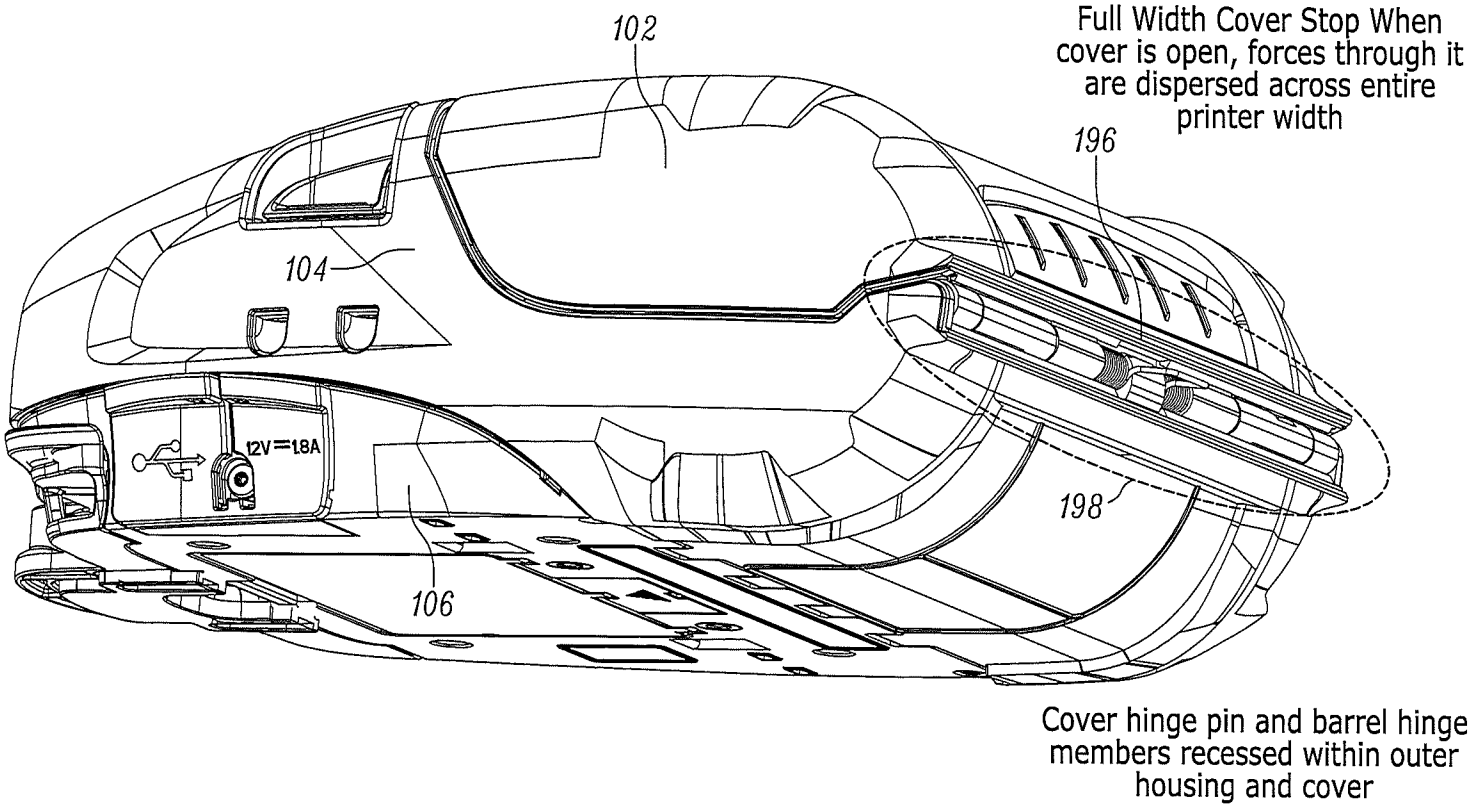
Figure 23B:
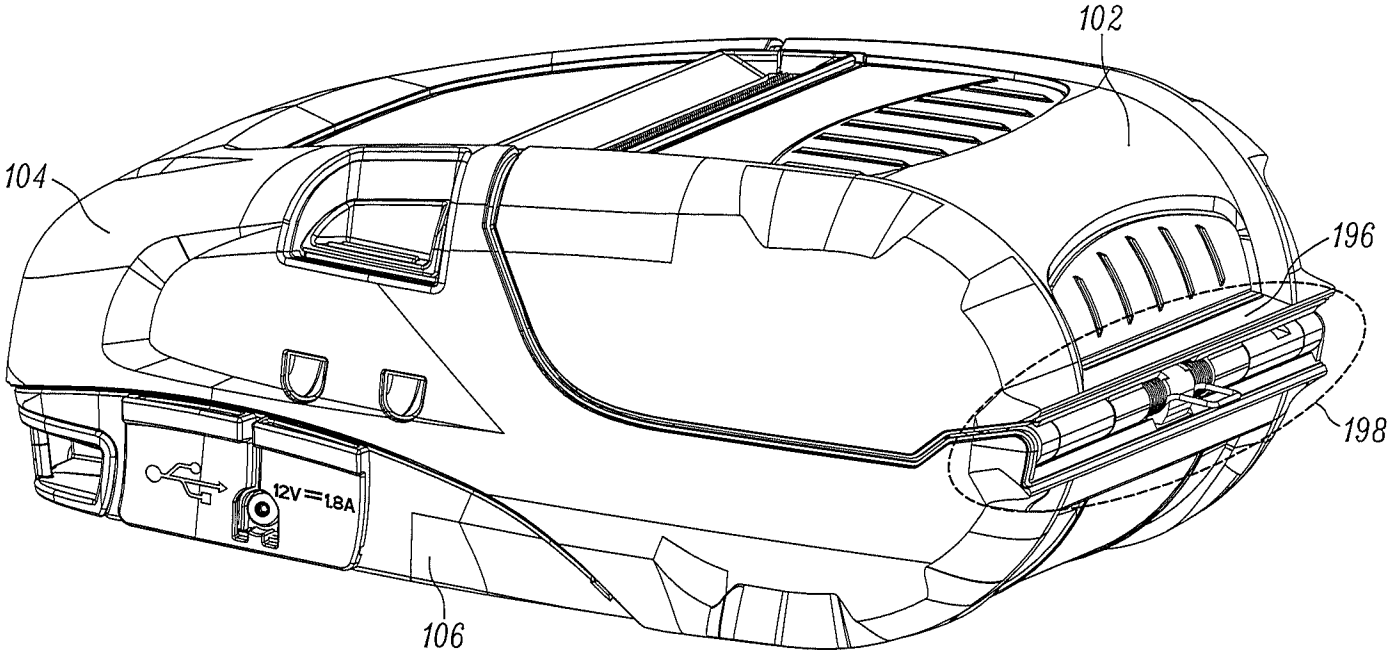

Having thus described certain embodiments of the invention in general terms, reference will now be made to the accompanying drawings, which are not necessarily drawn to scale, and wherein:

FIGS. 1A, 1B, and 1C illustrate an example mobile printer in accordance with an example embodiment of the present invention;

FIGS. 2A and 2B illustrate the cover hinge attachment structure of an example mobile printer in accordance with an example embodiment of the present invention;

FIGS. 3A and 3B illustrate the inner and outer cover attachment of an example mobile printer in accordance with an example embodiment of the present invention;

FIG. 4 illustrates an outer housing-media receiving housing fastening structure of an example mobile printer in accordance with an example embodiment of the present invention;

FIGS. 5A and 5B illustrate a media receiving housing fastening structure of an example mobile printer in accordance with an example embodiment of the present invention;

FIGS. 6A and 6B illustrate a series of cover to housing interlocks of an example mobile printer in accordance with an example embodiment of the present invention;

FIG. 7 illustrates a lower housing of an example mobile printer in accordance with an example embodiment of the present invention;

FIGS. 8A and 8B illustrate an outer housing of an example mobile printer in accordance with an example embodiment of the present invention;

FIG. 9 illustrates an base view and fastening structures of an example mobile printer in accordance with an example embodiment of the present invention;

FIG. 10 illustrates an assembly of a lower housing, outer housing and media receiving housing of an example mobile printer in accordance with an example embodiment of the present invention;

FIGS. 11, 12A, and 12B illustrate a front bumper component of an example mobile printer in accordance with an example embodiment of the present invention;

FIG. 13 illustrates a media receiving housing of an example mobile printer in accordance with an example embodiment of the present invention;

FIG. 14 illustrates a media guide assembly of an example mobile printer in accordance with an example embodiment of the present invention;

FIG. 15 illustrates a media guide belt assembly of an example mobile printer in accordance with an example embodiment of the present invention;

FIG. 16 illustrates the formation of a boxed assembly for the media guide belt assembly of an example mobile printer in accordance with an example embodiment of the present invention;

FIG. 17 illustrates an inner cover frame and platen assembly of an example mobile printer in accordance with an example embodiment of the present invention;

FIGS. 18A and 18B illustrate a platen holder of an example mobile printer in accordance with an example embodiment of the present invention;

FIG. 19 illustrates a display module of an example mobile printer in accordance with an example embodiment of the present invention;

FIG. 20 illustrates another view of a display module of an example mobile printer in accordance with an example embodiment of the present invention;

FIG. 21 illustrates another view of a display module of an example mobile printer in accordance with an example embodiment of the present invention;

FIGS. 22A and 22B illustrate another aspect of an outer housing of an example mobile printer in accordance with an example embodiment of the present invention; and FIGS. 23A and 23B illustrate alternate views of an example mobile printer in accordance with an example embodiment of the present invention.

DETAILED DESCRIPTION

The present invention now will be described more fully hereinafter with reference to the accompanying drawings, in which some, but not all embodiments of the inventions are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Mobile printers are used in a variety of applications and environments. In some cases, mobile printers may be subjected to unexpected impacts and drops while in operation or transit which may result in excessive movement of printer components and result in components disassembling or misaligning or breaking. Such excessive movements may cause damage to components resulting in printer failure and necessitating replacement of the components, possibly at considerable expense and significant downtime for the printer. For example, excessive movement during impacts or drops can result in damage to battery connectors, printed circuit board components, displays, and the like. Additionally, excessive stress within components caused by impacts and drops may cause material failure of the components.

For example, printer impacts might cause either hard failures or soft failures in the printer. Hard failures may cause a loss of printer function that cannot be corrected by reboot or other user intervention without tools. Soft failures may be failures that do not cause loss of function. Some soft failures may be corrected by user intervention without requiring the use tools. Hard failures may include a printer being unable to print (e.g., will not feed media, printer does not meet horizontal registration, poor print quality, cannot power on, or the like), being unable to charge, being unable to communicate with a host (wired or wireless communication), damaged and/or broken user interface (e.g., cracked or unreadable display, keypad or LEDs not functioning, or the like), loose parts moving around in an area inaccessible to the user, unable to load media (e.g., media cover will not open, media guide system not extending and retracting, or the like). Soft failures may include media cover opening during impact, battery separating from unit, temporary loss of connection to host (e.g., temporary loss of Bluetooth or WiFi connection), media ejected from printer, bosses stripped in housings, minor stress cracks and/or deformations to bumper.

Embodiments of the present invention provide improvements to printer durability including the use of engineered structures to limit bending, flexing, and/or twisting during impacts and the use of impact absorbing materials to prevent cracks and breaks and thereby maintain operational status of the printer. For example, embodiments provide improvements that strengthen traditional break areas by the use of improved materials and design optimization to distribute impact forces.

In some embodiments, design features add to the rigidity of the printer design to prevent twisting and flexing during impacts and thereby maintain operational status of the printer. For example, in some embodiments such design features include cover rigidity, lower housing structure, main housing unibody structure, assembly fastener points, front bumper structure, print frame structure, boxed media guide assembly, display module housing, strengthening rib structures, and the like.

In some embodiments, design features and materials add to the strength of the printer design in typical breakage areas.

For example, in some embodiments such design features include impact modified glass in displays, the use of long glass fibers, enclosed platen ends, full width cover stop, recessed cover hinge and knuckles, high impact modified polycarbonate, and the like.

Embodiments of the present invention provide printer design improvements that allow printers to maintain an operational status when subjected to repeated impacts. For example, the design and material improvements provided in embodiments allow a printer to continue to operate properly after being subjected to impacts from drops of up to two meters during a drop test based on the Department of Defense Test Method Standard MIL-STD-810G Method 516.6, procedure IV. During a drop test a printer is exposed to high impacts in specific orientations, including faces, edges, and corners. A drop test may be performed using a fixture to control height and orientation of the printer and where the printer impacts a concrete surface. The drop test may be performed such that the printer is dropped using different drop orientations so that every orientation (face, edge, corner) of the printer impacts the concrete surface (e.g., repeated for 26 drops, one drop in each different drop orientation). The drop test may be performed multiple times under different temperature conditions, such as ambient temperature, maximum operating temperature, and minimum operating temperature. The printer may be inspected for damage and functionality before the drop test and after each drop.

Embodiments of the present invention provide printer durability improvements which reduce or eliminate hard failures of the printer for a specified number of drop impacts. Embodiments may also reduce or minimize soft failures of the printer for a specified number of drop impacts. Limited soft failures may be acceptable for a specified number of drop impacts, such as cover opening less than 10% of total times dropped, media ejection less than 10% of total times dropped, battery separation less than 10% of total times dropped, minor bumper damage (e.g., printer can still be docked or belt clip and shoulder strap can still be attached, and where a piece of the bumper does not spate and create a sharp edge), minor stripping out of bosses in housings (e.g., where gap between housing does not exceed 0.75 mm). In example embodiments, the printer may continue to operate properly (e.g., have no hard failures and limited soft failures) for a total of twenty-six (26) two meter drops to concrete, entailing one drop to each face, edge, and corner (each drop orientation), at each of three temperature conditions (e.g., ambient temperature, maximum operating temperature, and minimum operating temperature).

In another example, the design and material improvements provided in embodiments allow a printer to continue to operate properly after being subjected to repeated impacts during a tumble test based on the International Electrotechnical Commission standard IEC 60068-2-32 Ed. 2.0 (1975) (incorporated in IEC 60068-2-31 Ed 2.0 (2008-05)). During a tumble test a printer is exposed to repetitive free-fall drops in random orientations. A tumble test may be performed using a tumbler, or rotating or tumbling barrel, fixture. During the tumble test, the printer impacts a smooth, hard, rigid surface of the tumbler. A tumble test is performed for a number of cycles, where a 360 degree rotation of the tumbler results in two hits and is considered two cycles. The printer may be inspected for damage and functionality before the tumble test and after certain specified intervals of tumbles (e.g., after every 100 tumbles; at 100, 200, 500, 750, 1000, 1500, 2000 tumbles, etc.).

Embodiments of the present invention provide printer durability improvements which reduce or eliminate hard failures of the printer for a specified number of repeated tumbles. Embodiments may also reduce or minimize soft failures of the printer for a specified number of repeated tumbles. Limited soft failures may be acceptable for a specified number of repeated tumbles, such as cover opening less than 10% of total times tumbled, media ejection less than 10% of total times tumbled, battery separation less than 10% of total times tumbled, minor bumper damage (e.g., printer can still be docked or belt clip and shoulder strap can still be attached, and where a piece of the bumper does not spate and create a sharp edge), minor stripping out of bosses in housings (e.g., where gap between housing does not exceed 0.75 mm). Earlier printers have been known to typically fail at 500 tumbles or less. In example embodiments, a printer continues to operate properly (e.g., have no hard failures and limited soft failures) after being subjected to up to two thousand one meter tumbles.

FIGS. 1A, 1B, and 1C illustrate views of an example mobile printer in accordance with an example embodiment of the present invention. FIG. 1A illustrates a front or display side view of the mobile printer, FIG. 1B illustrates a side/rear view of the mobile printer, and FIG. 1C illustrates a view with the cover in an open or media access position.

FIGS. 1A and 1B illustrate some of the main outer components of a printer in accordance with an example embodiment, the outer cover 102, the outer housing 104, and the lower housing 106. In the example embodiment, an egg crate/honeycomb edge profile of the outer cover provides additional structure and adds to the rigidity of the printer. FIG. 1 C illustrates the outer cover 102 and the inner cover frame 108 joined as a unit and rotated into an open or media access position, wherein the media receiving housing 110 is accessible, and the media 112 can be accessed and installed or removed from the printer.

FIGS. 2A and 2B illustrate a cover hinge attachment structure of an example mobile printer in accordance with an example embodiment of the present invention. FIG. 2A illustrates components of the example mobile printer including outer cover 102 with affixed inner cover frame 108 (not shown), media receiving housing 110, and hinge pin 114. Hinge pin 114 ties together the outer cover 102, inner cover frame 108, and media receiving housing 110 to form a cover/media housing assembly as illustrated in FIG. 2B.

As illustrated in FIG. 2A, inner cover frame 108 is structured with two first barrel hinge members 116 and outer cover 102 is structured with two second barrel hinge members 118. When the inner cover frame 108 is affixed to the outer cover 102, the first barrel hinge members 116 and second barrel hinge members 118 align coaxially as shown. The media receiving housing 110 is structured with two or more third barrel hinge members 120, and the third barrel hinge members 120 are configured to align coaxially with the first barrel hinge members 116 and second barrel hinge members 118 when the media receiving housing 110 is placed so as to join with the inner cover frame 108 and the outer cover 102, as illustrated in FIG. 2B. The coaxial arrangement of the first barrel hinge members, the second barrel hinge members, and the third barrel hinge members are structured to receive the hinge pin 114, as illustrated by the dotted line pattern in FIG. 2A. While the inner cover frame, outer cover, and media receiving housing are illustrated with two barrel hinge members, embodiments are not limited to such, and they may each be configured with more than two barrel hinge members.

As illustrated in FIG. 2A, the two first barrel hinge members 116 of the inner cover frame 108 define an outer hinge width and the hinge pin 114 defines a hinge pin length, where the hinge pin length is substantially equal to the outer hinge width, adding to the cover rigidity and preventing flexing and twisting of the components when assembled. When the hinge pin 114 is received within the coaxial arrangement of the first barrel hinge members 116, the second barrel hinge members 118, and the third barrel hinge members 120, the outer cover 102/inner cover frame 108 structure is pivotable relative to the media receiving housing 110 from a closed position to media access position, as illustrated in FIG. 1C.

FIGS. 3A and 3B illustrate an inner cover frame to outer cover attachment of an example mobile printer in accordance with an example embodiment of the present invention. The inner cover frame 108 may be attached to the outer cover 102 at the outer extremes. For example, as illustrated in FIG. 3A, the inner cover frame 108 is structured with a first plurality of fastener receivers 122 and the outer cover 102 is structured with a second plurality of fastener receivers 124. The inner cover frame 108 is configured to seat within the outer cover 102, as illustrated in FIG. 3B. The inner cover frame 108 is structured to be affixed to the outer cover 102 via the first plurality of fastener receivers 122 and the second plurality of fastener receivers 124, such that the inner cover frame and the outer cover are jointly pivotable as a unit from the closed position to the media access position.

The inner cover frame 108 may be further attached to the outer cover 102 at the frame arm ends via another plurality of fastener receivers 222 defined in the inner cover frame 108 and another plurality of fastener receivers 224 defined in the outer cover 102.

Such a fastening arrangement of the inner cover frame 108 to the outer cover 102 with a plurality of fasteners allows the components to act as a solid boxed structure which will not slide and/or twist individually. In some embodiments, the inner cover may be filled with long glass fiber for additional rigidity.

FIG. 4 illustrates a media housing and outer housing fastening structure of an example mobile printer in accordance with an example embodiment of the present invention. The media receiving housing 110 is configured to seat within the outer housing 104 and form a rigid structure, with the media receiving housing 110 being securely affixed to the outer housing 104, as illustrated in FIG. 5B. In example embodiments, the media receiving housing 110 is keyed to the outer housing 104, such as with one or more tongue and groove structures, to add to the rigidity and prevent twist and/or flex of the components in an impact.

For example, as illustrated in FIG. 4, the outer housing 104 is structured with one or more tongue structures 126 which are proximate a media lock edge 226 of the outer housing 104. The media receiving housing 110 is structured with one or more groove structures 128 which are proximate a housing lock edge 228 of the media receiving housing 110. The groove structures 128 of the media receiving housing 110 are structured to securely receive the tongue structures 126 of the outer housing 104 as the housing lock edge 228 of the media receiving housing 110 seats into the media lock edge 226 of the outer housing 104.

FIGS. 5A and 5B illustrate a media housing and outer housing fastening structure of an example mobile printer in accordance with an example embodiment of the present invention. In some embodiments, a plurality of fasteners, such as screws or the like, are strategically placed to the outer extremes of the media receiving housing 110 to securely tie the media receiving housing 110 (and by extension, the outer cover/inner cover frame assembly attached to the media receiving housing as illustrated in FIG. 2B) to the outer housing 104. In some embodiments, the media receiving housing 110 is further defined with a double wall construction to provide added rigidity to the printer design.

As illustrated in FIG. 5A, the media receiving housing 110 is structured with a third plurality of fastener receivers 130 which are defined at the outer extremes (e.g., at the four corners) of the media receiving housing 110. For example, as illustrated in FIG. 5, two fastener receivers 130 may be defined proximate the housing lock edge 228 of the media receiving housing 110 and two fastener receivers 130 may be defined proximate the media exit edge of the media receiving housing 110. The third plurality of fastener receivers 130 are structured to securely affix the media receiving housing 110 with the outer housing 104 when the media receiving housing 110 is seated within the outer housing 104, such as in association with another plurality of fastener receivers 230 defined in the outer housing 104.

FIGS. 6A and 6B illustrate a series of cover to housing interlocks of an example mobile printer in accordance with an example embodiment of the present invention. In example embodiments, the outer cover 102/inner cover frame 108 assembly may be keyed on the front sides and back to interlock with the outer housing 104 and media receiving housing 110 when the outer cover 102/inner cover frame 108 assembly is in the closed position, thereby providing additional strength and rigidity to the printer structure and preventing flexing and twisting of the components.

As illustrated in FIGS. 6A and 6B, the outer cover 102 is defined with one or more cover interlock elements, such as cover interlock elements 132*a*, cover interlock elements 132*b*, and cover interlock elements 132*c*. The cover interlock elements 132*a*-132*c* may be positioned along a cover to housing interface edge of the outer cover 102 and may define recess surfaces of the outer cover 102. The outer housing 104 is defined with one or more housing interlock elements, such as housing interlock elements 134*a* and housing interlock elements 134*b*. The media receiving housing 110 may also be defined with one or more housing interlock elements 134*c*. The housing interlock elements 134*a*-134*c* may be positioned along a housing to cover interface edge of the outer housing 104 and the media receiving housing 110 and may define rib surfaces of the outer housing 104 and the media receiving housing 110.

As illustrated in FIGS. 6A and 6B, the cover interlock elements 132*a*-132*c* and the housing interlock elements 134*a*-134*c* are structured such that they proximately align when the outer cover 102/inner cover frame 108 assembly is rotated from the media access position to the closed position. When in the closed position, the cover interlock element recess surfaces and the housing interlock element rib surfaces are proximately aligned such that the rib surfaces are seated against the recess surfaces. The interlock elements are structured to provide additional rigidity when the cover is in the closed position and prevent misaligning of the cover and the housing during an impact.

FIG. 7 illustrates a lower housing of an example mobile printer in accordance with an example embodiment of the present invention. FIGS. 8A and 8B illustrate views of an outer housing of an example mobile printer in accordance with an example embodiment of the present invention.

In example embodiments, the lower housing is defined with a battery pack box structure, multiple ribs connecting to the sidewalls of the lower housing, and a step feature along the display side of the lower housing, providing added rigidity to the printer design. The lower housing acts as a stiffener for the entire printer, and supports the outer housing sides, for example via tongue and groove structures or the like.

For example, as illustrated in FIG. 7, the lower housing 106 is defined with a battery pack box 136 and first and second sidewalls. The lower housing 106 is further defined with a plurality of ribs 138 extending generally between the battery pack box 136 and each of the first and second sidewalls.

The lower housing 106 is further defined with one or more lower housing tongue and groove structures 140 running along an outer housing join edge of each of a display side, a first sidewall, and a second sidewall of the lower housing 106. The outer housing 104 is further defined with one or more outer housing tongue and groove structures 142 running along a lower housing join edge of each of a display side, first sidewall, and second sidewall of the outer housing 104, as illustrated in FIG. 8B.

The lower housing tongue and groove structures 140 of the lower housing 106 are structured to align with the outer housing tongue and groove structures 142 of the outer housing 104. The lower housing tongue and groove structures 140 and the outer housing tongue and groove structures 142 are structured as secure join points between the lower housing 106 and the outer housing 104, wherein the lower housing sides support the outer housing sides.

As illustrated in FIG. 7, the lower housing 106 further defines a step feature 150 proximate a display edge of the lower housing 106. The step feature 105 is defined to receive a bumper component 156, as illustrated in FIG. 11. The step feature 150 and the bumper component 156 are structured to transmit impact loads and stresses away from a display side of the printer. For example, bumper contact points 152 move front impact stresses away from the center of the display side and down the sides of the lower housing.

In example embodiments, as illustrated in FIGS. 8A and 8B, the outer housing 104 defines a unibody one piece housing that connects the back side to the front.

As illustrated in FIGS. 7 and 8A, the lower housing 106 is further defined with two or more finger joints 144 proximate an outer housing interface edge of the lower housing 106 and the outer housing 104 is further defined with two or more reciprocal finger joints 146 proximate a lower housing interface edge of the outer housing 104. The reciprocal finger joints 146 of the outer housing 104 are structured to securely receive the two or more finger joints 144 of the lower housing 106 and act as secure fastening points between the outer housing 104 and the lower housing 106.

FIGS. 9 and 10 illustrate views of component attachments example of a mobile printer in accordance with an example embodiment of the present invention. In example embodiments, a plurality of fasteners, such as screws or the like, are used to tie together major structural components in the center of the printer, tying together such components as the lower housing, outer housing, print frame, and media receiving housing to provide added rigidity to the printer and providing a high strength unibody effect.

As illustrated in FIGS. 9 and 10, the lower housing 106 may be further defined with a fourth plurality of fastener receivers 148 proximate the outer housing interface edge of the lower housing 106. The fourth plurality of fastener receivers 148 being structured to securely join major components such as the lower housing 106, the outer housing 104, the print frame 154, and the media receiving housing 110 in the center of the printer.

FIGS. 11, 12A, and 12B illustrate a front bumper component of an example mobile printer in accordance with an example embodiment of the present invention. In example embodiments, a front bumper component 156 is affixed in the step feature 150 of the lower housing 106 just below the display to provide added display protection. The front bumper component 156 assists in preventing movement and/or compression of the housing around the display in front side impacts that could cause flexing or breaks in the display glass. The non-flexible bumper dissipates impact force down the sides of the printer where the bumper contacts the lower housing (bumper contact point 152 of FIG. 7) leaving the materials surrounding the display with relatively little movement.

As illustrated in FIG. 11, a display module 188 is affixed in the outer housing 104 and proximate the top surface of the step feature 150 of the lower housing 106 and above the bumper component 156. The bumper component 156 may be structured to extend outwardly beyond a forward edge of the display module 188 and bumper component 156 may be structured to reduce surface movement and/or compression due to front impacts proximate the display module 188 components.

In example embodiments, as illustrated in FIGS. 11, 12A, and 12B, the bumper component 156 provides added rigidity in the front, or display, side of the printer. The short vertical wall 158 of the lower housing 106 just above the bumper component 156 provides a rigid interface for the housing. The long depth lower housing wall 160, which forms the top of step feature 150, is long in the direction of front impacts and acts like a rib to resist front compression. This structural combination works to protect the front housing from flexing and breaking the glass of the display module 188.

FIG. 13 illustrates another view of a media receiving housing of an example mobile printer in accordance with an example embodiment of the present invention. FIG. 13 illustrates some components of a media guide assembly 162 structured to provide a media centering mechanism within the media receiving housing 110. As illustrated in FIG. 13, a first media guide 172 and a second media guide 174 are positioned at opposite ends of the inner surface of the media receiving housing 110. The first media guide 172 and second media guide 174 are structured to receive and securely hold the media 112 (not shown) during operation. The first media guide 172 and second media guide 174 define part of the media centering mechanism whereby the first media guide 172 and second media guide 174 may be moved in a synchronous or coordinated fashion to center and secure the media 112 within the media receiving housing 110.

In example embodiments, the media guides 172 and 174 may be constructed with long glass fibers to provide added strength and rigidity. In some example embodiments, the media guide may be fastened using an extra-long screw, such as at fastener receivers 262 of FIG. 14, that goes well into the media guide. A steel screw in fastening receiver 262 acts as a stiffening beam as well as a fastener.

FIG. 14 illustrates a media guide assembly of an example mobile printer in accordance with an example embodiment of the present invention. As illustrated in FIG. 14, the media guide assembly 162 defines a media guide belt 176 which is structured to encourage synchronous movement of the first media guide 172 and the second media guide 174 of the media centering mechanism. The first media guide 172 and the second media guide 174 define a first plurality of lugs and the media guide belt 176 defines a second plurality of lugs 178, where the first plurality of lugs and the second plurality of lugs are of equivalent number. The first plurality of lugs and the second plurality of lugs are structured to securely attach the media guide belt 176 to the media guide assembly 162 and prevent slipping or cutting of the media guide belt 176 under side impact stresses.

FIG. 15 illustrates a media guide belt assembly of an example mobile printer in accordance with an example embodiment of the present invention. FIG. 16 illustrates the formation of a boxed assembly for the media guide belt assembly of an example mobile printer in accordance with an example embodiment of the present invention.

As illustrated in FIGS. 15 and 16, the media receiving housing 110 defines a media guide assembly 162 proximate a media exit side of the media receiving housing 110. The media guide assembly 162 defines a media guide belt assembly 164 as part of the media centering mechanism. The media guide belt assembly 164 further defines a fifth plurality of fastener receivers 166.

The print frame 154 defines an attachment surface 168 with a sixth plurality of fastener receivers 170. The print frame attachment surface 168 is structured to securely attach proximate the external surface of the media exit side of the media receiving housing 110 and over the media guide belt assembly 164 via the fifth plurality of fastening receivers 166 and sixth plurality of fastening receivers 170. In example embodiments, the fifth and sixth pluralities of fastening receivers are defined in the four corners and the center of the print frame attachment surface 168 and the media guide belt assembly 164 to stiffen the entire assembly.

The print frame attachment surface 168 and the external surface of the media exit side of the media receiving housing 110 are structured to form a complete boxed assembly for the media guide belt assembly 164. The complete boxed assembly is structured to stiffen the entire assembly and prevent separation of components of the media guide belt assembly 164, such as pulleys, guides, and the like.

In some example embodiments, the print frame 154 is constructed using long glass fiber for extreme rigidity. The print frame 154 may be defined to fasten to the media receiving housing 110 via a plurality of fastener receivers and to a printed circuit board frame via a plurality of fastener receivers.

FIG. 17 illustrates an inner cover frame 108 with an affixed platen assembly of an example mobile printer in accordance with an example embodiment of the present invention. FIGS. 18A and 18B illustrate a platen holder component of a platen assembly of an example mobile printer in accordance with an example embodiment of the present invention. The platen ends breaking free from the cover or platen holder is a significant problem to overcome in impacts, for example in a two meter drop. In example embodiments, the platen holder is designed as a single piece part with holes that completely enclose both platen ends. In some example embodiments, the assembly of the platen and platen holder may be accomplished by adding one side of the platen shaft as a separate part, such as illustrated in FIG. 18B. This separate part can then be affixed by various means, including being screwed in to the platen shaft, press fit, or other similar means.

As illustrated in FIG. 18A, a platen holder 180 is defined to securely retain a platen 186. The platen holder 180 is further defined with a plurality of fastener receivers to be affixed proximate to a platen edge of the inner cover frame 108. The platen holder further defines a first hole 182 through a first solid endpiece of the platen holder 180 and a second hole 184 through a second solid endpiece of the platen holder 180. The first hole 182 is structured to completely encircle a first end of the platen 186 and the second hole 184 is structured to completely encircle a second end of the platen 186. The platen holder 180 is structured to prevent the platen 186 from breaking free from the inner cover frame 108 under impact stresses.

FIGS. 19, 20, and 21 illustrate a display module of an example mobile printer in accordance with an example embodiment of the present invention. Display glass may break from either direct impact or flexing. In example embodiments, the display is boxed within its own housing which provides direct impact protection, rigidity, and isolation. The boxed and sealed structure of the display module 188 provides impact, flex, and water protection. An impact foam gasket 190 that surrounds the display glass provides shock absorption, as illustrated in FIG. 20.

As illustrated in FIG. 21, the display module 188 is affixed within the outer housing 104 and is structured such that the display module 188 is allowed to float within the outer housing 104 to further isolate the display module 188 from shock and twist. As illustrated in FIGS. 20 and 21, a gasket 192 affixed between the display module 188 and the lower housing 106 and provides further water and impact shock protection.

FIGS. 22A and 22B illustrate another aspect of an outer housing of an example mobile printer in accordance with an example embodiment of the present invention. In some example embodiments, a rib structure is defined within the outer housing, such as behind a spring bar (not shown), to reduce flexing between the back side (e.g., media region) and front side (e.g., PCB region) of the housing. The rib structure may disburse some force through the spring bar and provide for reduced stress in the latches. The rib structure makes the entire unit act more like a single body resulting in the cover staying closed in drops.

As illustrated in FIGS. 22A and 22B, the outer housing 104 further defines a rib structure 194 extending proximate a spring bar (not shown), where the rib structure 194 is structured to reduce flexing between a first portion of the outer housing 104 and a second portion of the outer housing 104. The rib structure 194 is further structured to disburse impact forces received by the outer housing 104 through the spring bar (not shown).

FIGS. 23A and B illustrate another view of an example mobile printer in accordance with an example embodiment of the present invention. In some example embodiments, the outer cover defines a full width cover stop such that when the cover is in an open (media access) position, all forces through it are dispersed across the entire printer. The full width cover stop adds to the solid feel and durability, even allowing the open printer to be held by the cover.

As illustrated in FIGS. 23A and 23B, the outer cover 102 defines a cover stop 196 proximate a hinge edge of the outer cover 102. The cover stop 196 defines a cover stop length and the hinge edge of the outer cover 102 defines a cover width, where the cover stop length is substantially equal to the outer cover width. The cover stop 196 is structured to disperse forces across an entire printer width when the outer cover 102 is rotated in the media access position.

In some example embodiments, the hinge assembly (e.g., hinge pin 114, first barrel hinge members 116, second barrel hinge members 118, and third barrel hinge members 120 of FIGS. 2A and 2B) is recessed within the outer cover and outer housing for added protection during impacts. As illustrated in FIGS. 23A and 23B, having received the hinge pin 114, the first barrel hinge members 116, the second barrel hinge members 118, and the third barrel hinge members 120 are defined to be in a recessed position 198 between the hinge edge of the outer cover 102 and the hinge edge of the outer housing 104.

In some example embodiments, additional design features and materials may be used to provide added strength in typical breakage areas. For example, a display module may use impact modified glass, cover latch hooks may be composed of steel or similar materials, a gear train may be defined with a steel rear post and wider gears for added strength, and outer housings may be constructed with high impact modified polycarbonate with thermoplastic elastomer (TPE) overmold.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A printer comprising:

a media receiving housing;

a print frame defining an attachment surface having a first plurality of fastener receivers, the print frame attachment surface structured to securely attach proximate an external surface of the media exit side of the media receiving housing via a second plurality of fastener receivers;

a media guide assembly structured to provide a media centering mechanism within the media receiving housing, the media centering mechanism including a first media guide and a second media guide; and a media guide belt structured to aid synchronous movement of first media guide and the second media guide, the media guide belt defining a first plurality of lugs, the first media guide defining a second plurality of lugs structured to matingly engage the first plurality of lugs to securely attach the media guide belt to the media guide assembly, wherein:

the first plurality of lugs remains fixedly mated with the second plurality of lugs during the synchronous movement of the first and second media guides;

the first plurality of lugs is linearly arranged; and the second plurality of lugs is linearly arranged complimentarily to the first plurality of lugs such that the first plurality of lugs is linearly aligned with the second plurality of lugs.

2. A printer as defined in claim 1, wherein the media guide assembly is proximate a media exit side of the media receiving housing.

3. A printer as defined in claim 2, wherein the print frame attachment surface and the external surface of the media exit side of the media receiving housing are structured to act as a complete boxed assembly for the media guide belt.

4. A printer as defined in claim 1, further comprising:

an outer housing;

a media lock edge;

a housing lock edge; and a plurality of fastener receivers at outer extremes of the media receiving housing proximate the housing lock edge and proximate the media exit edge, the plurality of fastener receivers structured to securely affix the media receiving housing with the outer housing.

5. A printer as defined in claim 4 further comprising an outer cover defining a cover interlock element, the cover interlock element defining a recess surface, the outer housing defining housing interlock elements, the housing interlock elements defining a rib surface, the cover interlock element recess surface and the housing interlock element rib surface structured such that the cover interlock element recess surface and the housing interlock element rib surface proximately align when the outer cover is rotated from a media access position to a closed position.

6. A printer as defined in claim 4, further comprising a lower housing defining two or more finger joints proximate an outer housing interface edge of the lower housing, the outer housing further defining two or more reciprocal finger joints proximate a lower housing interface edge of the outer housing, the two or more reciprocal finger joints of the outer housing structured to receive the two or more finger joints of the lower housing.

7. A printer as defined in claim 1, further comprising a lower housing defining a battery box and first and second sidewalls, the lower housing further defining a plurality of ribs extending between the battery box and each of the first and second sidewalls, the plurality of ribs providing rigidity to the lower housing.

8. A printer as defined in claim 7, the lower housing defining a step feature proximate a display edge of the lower housing, the step feature structured to receive a bumper, and the step feature and the bumper structured to transmit impact loads and stresses away from a display side of the printer.

9. A printer as defined in claim 8, further comprising a display module coupled to an outer housing, the display module proximate the step feature and above the bumper.

10. A printer as defined in claim 9, the bumper structured to extend outwardly beyond a forward edge of the display module.

11. A printer as defined in claim 1, the media receiving housing defining two or more barrel hinge members, the barrel hinge members structured for positioning in a coaxial arrangement for receiving a hinge pin, a hinge pin length being substantially equal to an outer hinge width.

12. A printer as defined in claim 1, wherein the first plurality of lugs being fixedly mated to the second plurality of lugs enables the printer to maintain an operational status following a drop test, the drop test comprising a plurality of two-meter drops initiated from different printer drop orientations.

13. A printer as defined in claim 12, wherein the drop test comprises twenty-six drops, each drop initiated from a different printer drop orientation of the printer.

14. A printer as defined in claim 1, wherein the first plurality of lugs being fixedly mated to the second plurality of lugs enables the printer to maintain an operational status following a tumble test, the tumble test comprising a plurality of one-meter tumbles.

15. A printer as defined in claim 14, wherein the first plurality of lugs being fixedly mated to the second plurality of lugs enables the printer to maintain the operational status following 750 tumbles.

16. A printer as defined in claim 14, wherein the first plurality of lugs being fixedly mated to the second plurality of lugs enables the printer to maintain the operational status following 1000 tumbles.

17. A printer as defined in claim 14, wherein the first plurality of lugs being fixedly mated to the second plurality of lugs enables the printer to maintain the operational status following 2000 tumbles.

18. A printer comprising:

a media receiving housing;

a lower housing defining a battery box and first and second sidewalls, the lower housing further defining a plurality of ribs extending between the battery box and each of the first and second sidewalls, the plurality of ribs providing rigidity to the lower housing;

a media guide assembly structured to provide a media centering mechanism within the media receiving housing, the media centering mechanism including a first media guide and a second media guide; and a media guide belt structured to aid synchronous movement of first media guide and the second media guide, the media guide belt defining a first plurality of lugs, the first media guide defining a second plurality of lugs structured to matingly engage the first plurality of lugs to securely attach the media guide belt to the media guide assembly, wherein:

the first plurality of lugs remains fixedly mated with the second plurality of lugs during the synchronous movement of the first and second media guides;

the first plurality of lugs is linearly arranged; and the second plurality of lugs is linearly arranged complimentarily to the first plurality of lugs such that the first plurality of lugs is linearly aligned with the second plurality of lugs.

19. A printer as defined in claim 18, the lower housing defining a step feature proximate a display edge of the lower housing, the step feature structured to receive a bumper, and the step feature and the bumper structured to transmit impact loads and stresses away from a display side of the printer.

20. A printer as defined in claim 19, further comprising a display module coupled to an outer housing, the display module proximate the step feature and above the bumper.

* * * * *